US009238884B2

(12) United States Patent
Tobi et al.

(10) Patent No.: US 9,238,884 B2
(45) Date of Patent: Jan. 19, 2016

(54) WASHING MACHINE

(75) Inventors: Yukio Tobi, Ota (JP); Haruo Mamiya, Yasu (JP); Takayoshi Akagi, Ota (JP)

(73) Assignees: HAIER GROUP CORPORATION, Shandong (CN); QINGDAO HAIER WASHING MACHINE CO., LTD., Shandong (CN)

( * ) Notice: Subject to any disclaimer, the term of this patent is extended or adjusted under 35 U.S.C. 154(b) by 1108 days.

(21) Appl. No.: 12/809,944

(22) PCT Filed: Oct. 8, 2008

(86) PCT No.: PCT/JP2008/068297

§ 371 (c)(1),
(2), (4) Date: Jun. 21, 2010

(87) PCT Pub. No.: WO2009/081640

PCT Pub. Date: Jul. 2, 2009

(65) Prior Publication Data

US 2011/0048078 A1 Mar. 3, 2011

(30) Foreign Application Priority Data

Dec. 26, 2007 (JP) ..... 2007-334932

(51) Int. Cl.
*D06F 33/00* (2006.01)
*D06F 35/00* (2006.01)
(Continued)

(52) U.S. Cl.
CPC ..... *D06F 35/001* (2013.01); *D06F 35/002* (2013.01); *D06F 35/005* (2013.01);
(Continued)

(58) Field of Classification Search
CPC ..... D06F 35/001; D06F 35/002; D06F 39/08; D06F 39/088; D06F 39/083; D06F 2232/06; D06F 35/007; D06F 35/005; D06F 2226/00
USPC ..... 68/5 C, 12.13; 8/149.1, 149.2
See application file for complete search history.

(56) References Cited

U.S. PATENT DOCUMENTS 3,783,651 A * 1/1974 Karklys ..... 68/12.23
4,441,340 A * 4/1984 Kaplan ..... 68/12.01
(Continued)

FOREIGN PATENT DOCUMENTS

DE 40 04 057 A1 8/1991
EP 0 518 806 A1 12/1992
(Continued)

OTHER PUBLICATIONS

Extended European Search Report and European Search Opinion issued in European Patent Application No. 08863792.1, dated May 31, 2011.
(Continued)

*Primary Examiner* — Michael Barr
*Assistant Examiner* — Kevin G Lee
(74) *Attorney, Agent, or Firm* — Brinks Gilson & Lione

(57) ABSTRACT

The inventive washing machine is capable of hygienically and properly performing a rinsing operation with the use of bathwater. The washing machine includes a bathwater pump (34), so that bathwater can be retained in a washing tub (3). A water circulation passage (42, 43, 44, 45, 15, 55, 25, 57, 26, 58, 59) is provided for circulating laundry water to the washing tub (3). The bathwater retained in the washing tub (3) is circulated through the water circulation passage, and ozone generated by an ozone generator (19) is mixed with the circulated water, whereby the water (bathwater) is cleaned. This water cleaning operation is performed in a rinsing step. When the ozone is supplied in the rinsing step, the ozone is effective to sterilize the bathwater and decompose dirt and odorant of laundry. Therefore, the rinsing operation to be performed in this manner is comparable to a rinsing operation to be performed with the use of tap water.

6 Claims, 18 Drawing Sheets

(51) Int. Cl.
*D06F 39/08* (2006.01)
*D06F 25/00* (2006.01)

(52) U.S. Cl.
CPC ..... *D06F35/006* (2013.01); *D06F 35/007* (2013.01); *D06F 39/08* (2013.01); *D06F 39/083* (2013.01); *D06F 39/088* (2013.01); *D06F 25/00* (2013.01); *D06F 2226/00* (2013.01); *D06F 2232/06* (2013.01)

(56) References Cited

U.S. PATENT DOCUMENTS

| | | | | |
|---|---|---|---|---|
| 5,097,556 | A * | 3/1992 | Engel et al. | 8/158 |
| 5,181,399 | A | 1/1993 | Engel et al. | |
| 5,313,811 | A * | 5/1994 | Wasinger et al. | 68/5 C |
| 5,737,790 | A * | 4/1998 | Badger et al. | 8/158 |
| 5,763,382 | A * | 6/1998 | Cooper et al. | 510/303 |
| 5,765,403 | A * | 6/1998 | Lincoln et al. | 68/13 R |
| 6,507,965 | B2 * | 1/2003 | Kown | 8/158 |
| 2007/0107473 | A1 * | 5/2007 | Park | 68/12.14 |
| 2008/0184746 | A1 * | 8/2008 | Agarwal | 68/12.02 |

FOREIGN PATENT DOCUMENTS

| | | | |
|---|---|---|---|
| EP | 1 036 888 | A2 | 9/2000 |
| JP | 62-114596 | | 5/1987 |
| JP | 04-244198 | | 9/1992 |
| JP | 07-144086 | | 6/1995 |
| JP | 11-276794 | | 10/1999 |
| JP | 2001-087590 | | 4/2001 |
| JP | 2001-187294 | | 7/2001 |
| JP | 2004-024597 | | 1/2004 |
| JP | 2007-181560 | | 7/2007 |
| JP | 2007-181597 | | 7/2007 |
| JP | 2007-181608 | | 7/2007 |
| JP | 2007181608 | A | 7/2007 |
| WO | WO 2009/081641 | A1 | 7/2009 |

OTHER PUBLICATIONS

Notification Concerning Transmittal of Copy of International Preliminary Report on Patentability (Form PCT/IB/326), w/ English translation thereof (Form PCT/IB/338), issued in International Application No. PCT/JP2008/068297 filed Oct. 8, 2008.

European Office Action for Application No. 08 863 792.1-1710, dated Apr. 14, 2015.

* cited by examiner

WASHING MACHINE

RELATED APPLICATIONS

This application is the U.S. National Phase under 35 U.S.C. §371 of International Application No. PCT/JP2008/068297, filed on Oct. 8, 2008, which in turn claims the benefit of Japanese Application No. 2007-334932, filed on Dec. 26, 2007, the disclosures of which Applications are incorporated by reference herein.

TECHNICAL FIELD

The present invention relates to a washing machine and, particularly, to a washing machine which performs a laundry process with laundry water mixed with cleaning air.

BACKGROUND ART

The inventor of the present invention previously proposes a washing machine including a mechanism capable of cleaning water used for a laundry process with the use of ozone (see Patent Document 1).

The washing machine disclosed in Patent Document 1 includes a water storage tank, and is configured to clean water stored in the water storage tank with ozone.

Further, the inventor of the present invention previously proposes a rinsing method in which dirt and a detergent component are rinsed away from garment by performing a rinsing operation a reduced number of times, and a washing machine which performs the rinsing method (see Patent Document 2).

Patent Document 1: Japanese Unexamined Patent Application Publication No. 2007-181608

Patent Document 2: Japanese Unexamined Patent Application Publication No. 2007-181597

DISCLOSURE OF THE INVENTION

Problems to be Solved by the Invention

The washing machine disclosed in Patent Document 1, which is configured to store the water used for the laundry process in the water storage tank and clean the stored water with ozone for reuse, is advantageous for water saving.

On the other hand, there is a demand for a washing machine which is capable of properly cleaning the laundry with the use of clean water by performing the laundry process while cleaning water being used for the laundry process rather than cleaning the water used for the laundry process.

In particular, a washing machine capable of properly rinsing dirt and a detergent component away from the laundry in a rinsing step, and a washing machine capable of performing the rinsing step with the use of bathwater are also in demand.

In view of the foregoing, it is a principal object of the present invention to provide a washing machine which is capable of using bathwater for the rinsing operation, and properly performing the rinsing operation.

It is another object of the present invention to provide a washing machine which is capable of efficiently cleaning rinsing water by circulating the rinsing water during the rinsing operation and cleaning the circulated rinsing water.

It is further another object of the present invention to provide a washing machine which is capable of properly performing the rinsing operation.

Means for Solving the Problems

According to the present invention, there is provided a washing machine including: a washing tub; a water supply valve which is opened and closed to supply tap water into the washing tub; a bathwater pump which is driven to supply bathwater into the washing tub; a water circulation passage having opposite ends connected to the washing tub; a circulation pump provided in the water circulation passage for pumping water out of the washing tub through one of the opposite ends of the water circulation passage and supplying the pumped water back into the washing tub through the other end of the water circulation passage; a cleaning air generator which generates cleaning air; a gas-liquid mixer provided in the water circulation passage for mixing the cleaning air generated by the cleaning air generator with water flowing through the water circulation passage; and bathwater cleaning controlling means which actuates the cleaning air generator to mix the cleaning air with water circulated by driving the circulation pump in response to supply of the bathwater into the washing tub by the bathwater pump.

The bathwater cleaning controlling means may actuate the cleaning air generator for a predetermined period that is longer than when the tap water is supplied into the washing tub.

The inventive washing machine is preferably capable of performing a washing step by using detergent water retained in the washing tub and containing a detergent dissolved therein, and then performing a rinsing step, wherein the bathwater cleaning controlling means is operative only in the rinsing step.

The inventive washing machine is capable of performing an intermediate dehydrating step to remove the detergent water used in the washing step between the washing step and the rinsing step, and further includes intermediate dehydration controlling means which employs a longer dehydration period for the intermediate dehydrating step when the rinsing step is to be performed with the bathwater cleaning controlling means kept operative than when the rinsing step is to be performed by using the tap water.

The inventive washing machine may further include water supply/drain controlling means which, when the bathwater is supplied into the washing tub by driving the bathwater pump in the rinsing step, opens and closes a drain valve to drain water from the washing tub in predetermined timing relation with the supply of the bathwater.

In the inventive washing machine, the rinsing step in which the bathwater cleaning controlling means is operative may include a plurality of rinsing steps, and intermediate dehydrating steps to be performed before the respective rinsing steps, and a dehydration period may be longer in an intermediate dehydrating step to be performed before a preceding rinsing step than in an intermediate dehydrating step to be performed before a subsequent rinsing step.

The rinsing step in which the bathwater cleaning controlling means is operative may include a plurality of rinsing steps, and a bathwater supply period may be longer in the preceding rinsing step than in the subsequent rinsing step.

The rinsing step in which the bathwater cleaning controlling means is operative may include a plurality of rinsing steps, and the inventive washing machine may further include finishing treatment controlling means which deactuates the cleaning air generator and supplies a softener into the washing tub in a last one of the rinsing steps.

Effects of the Invention

According to the present invention, the provision of the bathwater pump makes it possible to use the bathwater as washing water or rinsing water to be retained in the washing tub. The provision of the water circulation passage and the circulation pump makes it possible to circulate the water from the washing tub through the water circulation passage. Further, the provision of the cleaning air generator and the gas-liquid mixer makes it possible to mix the cleaning gas with the water circulated through the water circulation passage for cleaning the water retained in the washing tub.

When the bathwater is supplied into the washing tub, the bathwater cleaning controlling means preferably performs a control operation so as to mix the cleaning air with the water circulated from the washing tub for the predetermined period that is longer than when the tap water is supplied into the washing tub. Therefore, the bathwater retained in the washing tub can be advantageously cleaned. In general, the bathwater contains bacteria and the like. However, the bathwater is sterilized by mixing the cleaning air with the bathwater for the longer period. This makes it possible to hygienically and properly perform a laundry process. That is, the laundry process is hygienically and properly performed with the use of the bathwater.

The bathwater cleaning controlling means may be operative only in the rinsing step, so that the cleaning air is mixed with the bathwater to clean the bathwater only in the rinsing step. Even if the cleaning air is mixed with the detergent water to be used in the washing step, the cleaning air is combined with a detergent component to be consumed by the detergent component. This makes it almost impossible to decompose dirt, odorant and the like contained in the detergent water for cleaning the water. Therefore, an inefficient and wasteful operation such that the cleaning air is mixed with the detergent water is not performed. Instead, the circulation pump is driven and the cleaning air generator is actuated only in the rinsing step, whereby the bathwater is efficiently and effectively cleaned.

As a result, the function of the detergent component contained in the detergent water is not impaired by the cleaning air, making it possible to properly perform a washing operation in the washing step. Further, it is possible to properly perform a rinsing operation in the rinsing step, while achieving the cleaning of the bathwater and the sterilization of garment.

Where the intermediate dehydrating step is performed after the washing step and then the rinsing step is performed with the use of the bathwater, the intermediate dehydrating step may be performed for a longer dehydration period. By performing the intermediate dehydrating step for the longer dehydration period, the detergent water is sufficiently removed from the laundry. Therefore, the amount of a residual detergent component is reduced when the bathwater is supplied in the rinsing step. If a greater amount of the detergent component used in the washing step remains as the residual detergent component when the bathwater cleaned by the mixing of the cleaning air is used as the rinsing water, the cleaning air is consumed for removal of the residual detergent component, failing to satisfactorily remove the bacteria and the like contained in the bathwater. With this arrangement, the amount of the detergent water used in the washing step is reduced by increasing the dehydration period of the intermediate dehydrating step, so that the bathwater can be satisfactorily cleaned in the rinsing step.

Where the supply of the bathwater into the washing tub in the rinsing step is achieved by additionally supplying bathwater into the washing tub while partly draining the bathwater supplied into the washing tub, it is possible to reduce the amount of the residual detergent component remaining in the bathwater retained in the washing tub.

Therefore, the bathwater is advantageously cleaned when the bathwater cleaning controlling means is operative in the rinsing step.

Since the amount of the residual detergent component is greater in the preceding rinsing step, the dehydration period is preferably longer in the intermediate dehydrating step to be performed before the preceding rinsing step than in the intermediate dehydrating step to be performed before the subsequent rinsing step. This efficiently reduces the amount of the residual detergent component, making it possible to efficiently clean the bathwater with the cleaning air in the rinsing step.

Further, the rinsing step is divided into the plurality of rinsing steps, whereby the laundry can be efficiently rinsed. More specifically, where the rinsing step is divided into a first rinsing step and a second rinsing step, the detergent water used in the washing step remains in the laundry to be rinsed, and a relatively great amount of the residual detergent component is supposedly present in the rinsing water in the first rinsing step. Therefore, the bathwater supply period is increased to reduce the concentration of the residual detergent component.

In the second rinsing step, almost all the residual detergent component is removed from the rinsing water, so that the cleaning air is mainly used for the sterilization of the bathwater and the laundry and for decomposition of greasy dirt adhering to the laundry. In the second rinsing step, the bathwater supply period is reduced. Thus, the rinsing operation can be efficiently performed in a shorter period of time.

The finishing treatment controlling means deactuates the cleaning air generator when the softener is supplied into the washing tub. This prevents the softener from being decomposed or deactivated by the cleaning air, thereby ensuring proper operation of the washing machine without any inconvenience.

As described above, the present invention ensures that the rinsing operation is advantageously performed with the use of the bathwater in the rinsing step.

DESCRIPTION OF REFERENCE CHARACTERS

Figure 1:
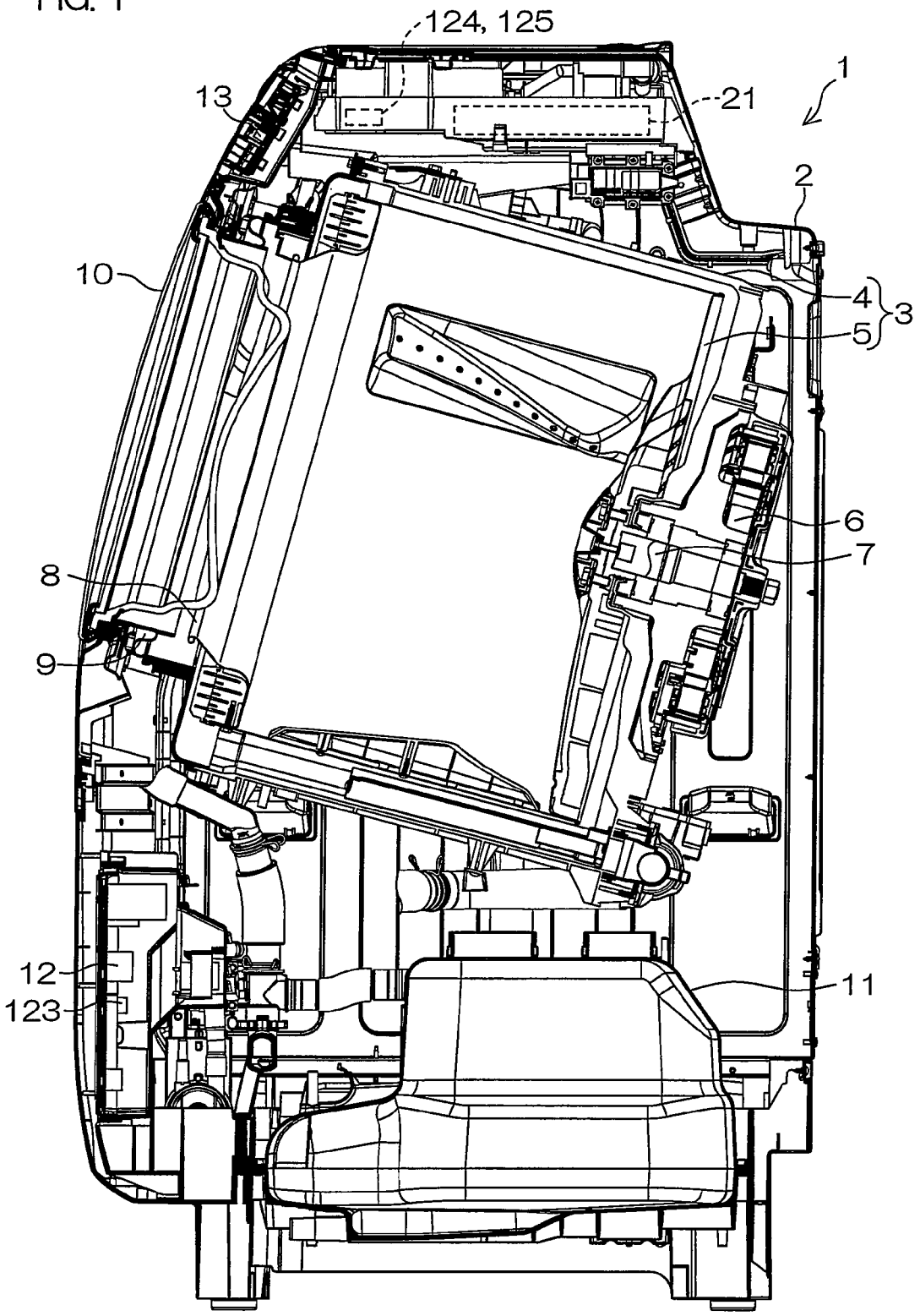
FIG. 1 is a right side view illustrating, in vertical section, a washing/drying machine 1 according to one embodiment of the present invention.

1: Washing/drying machine
3: Washing tub
4: Outer tub
5: Drum
6: DD motor
15: Filter unit
17: Water supply valve
19: Ozone generator
25: Circulation pump
26: U-turn portion
27: Gas-liquid mixer
44: First drain valve
48: Second drain valve
57: Second water circulation passage
58: Venturi tube
59: Third water circulation passage
77: Restrictive flow passage
81: Check valve
83: Filter body
120: Control section
150: Case

BEST MODE FOR CARRYING OUT THE INVENTION

The construction of a washing/drying machine of a so-called oblique drum type according to one embodiment of the present invention will hereinafter be described specifically with reference to the drawings.

Construction and Operation of Washing/Drying Machine

FIG. 1 is a right side view illustrating, in vertical section, the washing/drying machine 1 according to one embodiment of the present invention. The washing/drying machine 1 includes a washing tub 3 disposed obliquely in a housing 2. The washing tub 3 includes an outer tub 4 in which water is retained in a laundry process, and a drum 5 rotatably accommodated in the outer tub 4. The drum 5 is rotated about a rotation shaft 7 by a DD motor 6 provided rearward of the outer tub 4. The rotation shaft 7 extends obliquely upward toward the front to provide a so-called oblique drum structure. An opening 8 of the drum 5 and an opening 9 of the outer tub 4 are covered and uncovered with a door 10 attached to the housing 2. With the door 10 being opened, garment (laundry) is loaded into and unloaded from the drum 5 through the openings 8, 9.

The washing/drying machine 1 includes a tank 11 provided below the washing tub 3 for storing used water (recycling water). The tank 11 has an internal volume of about 8.5 liters. Water used for a rinsing operation is stored in the tank 11, and is used as heat-exchange water and cleaning water for removing lint and the like from an air circulation duct in a drying process.

An electrical component 12 including a main control board is provided in a lower front portion of the housing 2, and an electrical component 13 for display and input operation is provided in an upper front portion of the housing 2. The lower electrical component 12 includes a board temperature sensor 123.

Further, a blower 21 to be driven in the drying process to be described later, and a drying heater A 124 and a drying heater B 125 for heating air circulated into the washing tub 3 by the blower 21 are provided in an upper portion of the housing 2.

Figure 2:
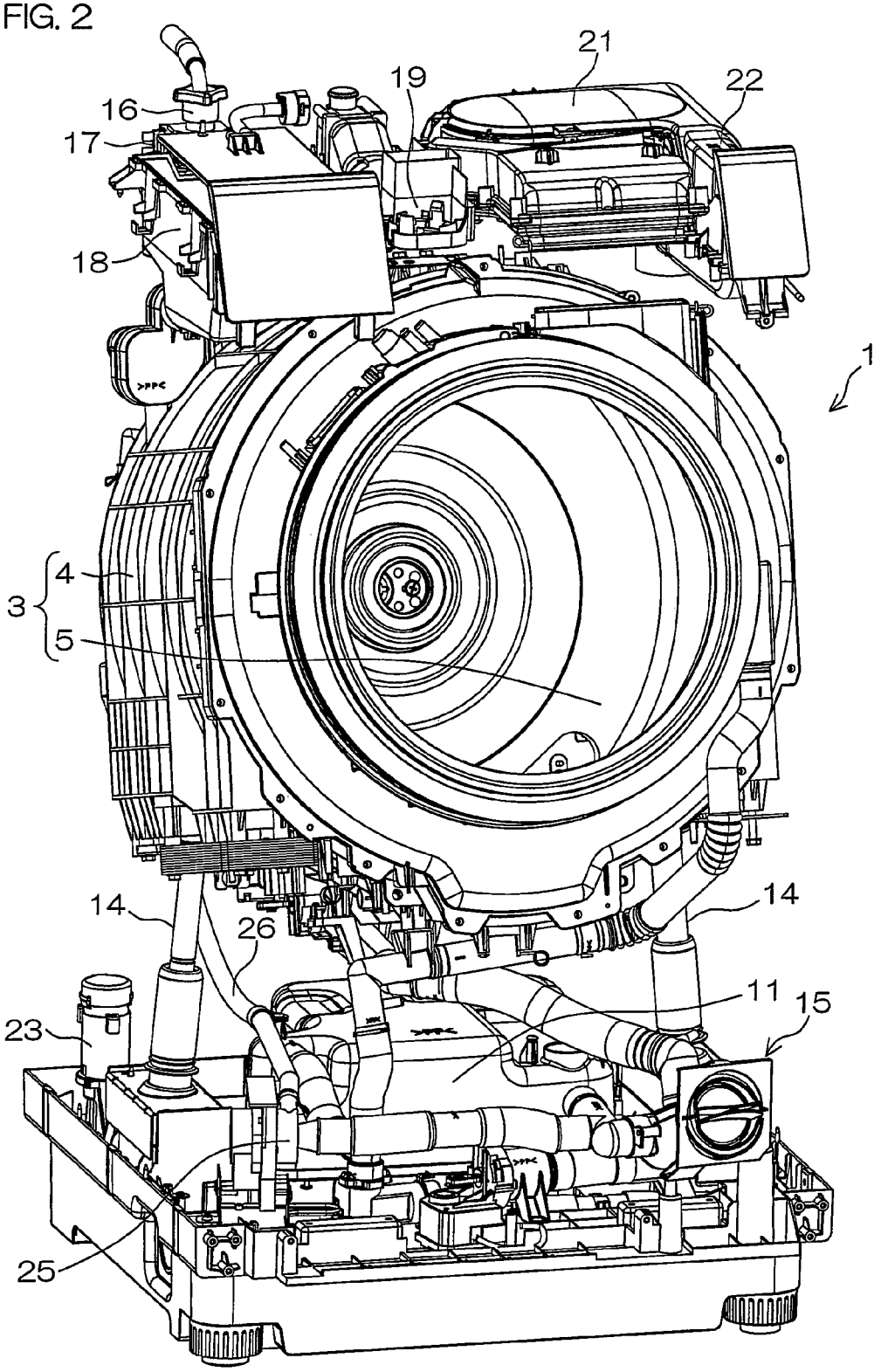
FIG. 2 is a perspective view showing the internal construction of the washing/drying machine 1 with its housing 2 removed as seen obliquely from the front side.
Figure 3:
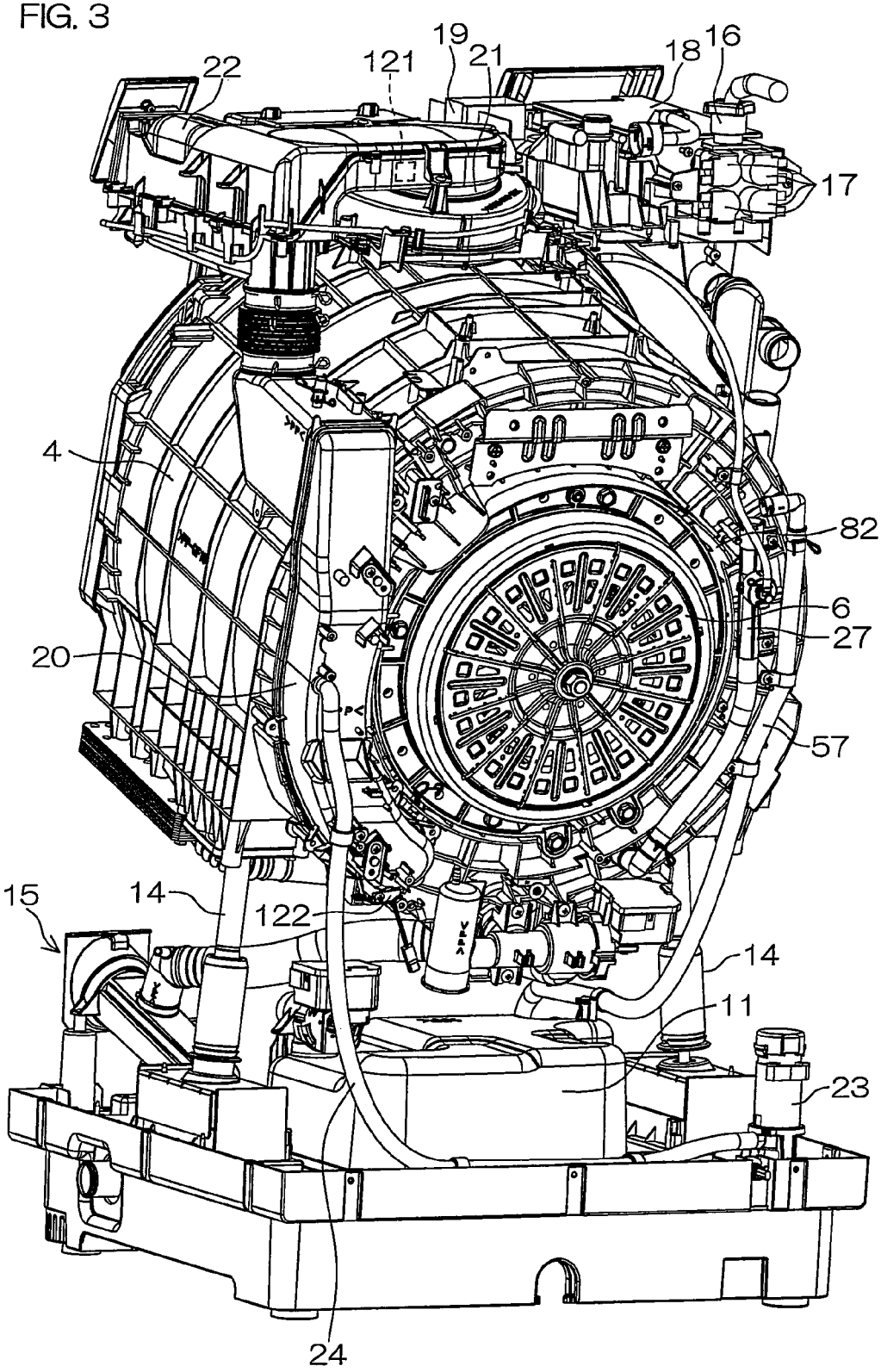
FIG. 3 is a perspective view showing the internal construction of the washing/drying machine 1 with its housing 2 removed as seen obliquely from the rear side.

FIG. 2 is a perspective view showing the internal construction of the washing/drying machine 1 according to the embodiment of the present invention with the housing 2 removed as seen obliquely from the front side. FIG. 3 is a perspective view showing the internal construction of the washing/drying machine 1 with its housing 2 removed as seen obliquely from the rear side.

In FIGS. 2 and 3, the reference numeral 3 denotes the washing tub, which includes the outer tub 4 and the drum 5. The washing tub 3 is supported by resilient support members 14 each including a coil spring and a damper. The tank 11 is disposed below the washing tub 3. A filter unit 15 is disposed on a front right side of the tank 11, and connected to the washing tub 3 and the tank 11 through predetermined hoses and pipes.

A water plug 16, a water supply valve 17 for controlling supply of water flowing from the water plug 16 into a water passage, a water supply port unit 18, an ozone generator 19 which generates ozone as a cleaning gas, the blower 21 for circulating air through a drying air duct 20 in the drying process, and a drying filter unit 22 for trapping foreign matter such as lint contained in the air circulated through the drying air duct 20 by the blower 21 are provided above the washing tub 3.

In the laundry process (a washing step or a rinsing step), tap water supplied from the water plug 16 is retained in the washing tub 3 by controlling the water supply valve 17. At this time, water containing a detergent dissolved therein can be retained in the washing tub 3 by causing water to flow into the washing tub 3 through a detergent container 29 in the water supply port unit 18. In the laundry process, the drum 5 is rotated by the DD motor 6. Further, the water is pumped out of the washing tub 3 through the filter unit 15 by a circulation pump 25, and the pumped water is guided to a rear upper side of the outer tub 4 through a water circulation passage (second water circulation passage 57) and flows down from the upper side and then back into the washing tub 3 from a lower portion of a rear face of the washing tub 3 for circulation. A gas-liquid mixer 27 is provided in the water circulation passage, and the ozone generated by the ozone generator 19 is mixed with the water flowing down from the upper side in the gas-liquid mixer 27. With the ozone mixed with the water, the water is cleaned by the strong oxidation and sterilization power of the ozone. That is, the water in the washing tub 3 is circulated in the laundry process, and cleaned by mixing the ozone with the circulated water for use in the laundry process. As shown in FIG. 3, a projection 82 is provided in the vicinity of the gas-liquid mixer 27 as projecting rearward from a rear face of the outer tub 4 for protecting the gas-liquid mixer 27 attached to the rear face of the outer tub 4 when the outer tub 4 is wobbled to bump against the housing.

In the drying process, air is sucked out of the washing tub 3 from a lower portion of a rear surface of the washing tub 3, and guided upward through the drying air duct 20. After foreign matter is filtered away from the air by the drying filter unit 22, the air flows into the washing tub 3 from an upper front side of the washing tub 3 for circulation. High-temperature high-humidity air is heat-exchanged with water to be thereby cooled and dehumidified when being circulated through the drying air duct 20. For this purpose, water is supplied into the drying air duct 20. That is, the washing/drying machine is configured such that water is pumped up from the tank 11 by a drying pump 23, and supplied to a predetermined portion (first position) of the drying air duct 20 via a duct water supply passage 24 such as of a hose. Though not shown, a water passage for supplying the tap water into the drying air duct 20 from the water plug 16 via the water supply valve 17 as required is also provided.

As shown in FIG. 3, a dehumidification water temperature sensor 122 for detecting the temperature of dehumidification water (resulting from the dehumidification of the circulated air through the heat exchange) falling through the drying air duct 20 is provided at a lower end of the drying air duct 20. A drum outlet temperature sensor 121 for detecting the temperature of the circulated air after the heat exchange is provided above the drying air duct 20.

While the construction and the operation of the washing/drying machine 1 have been thus described, the overall construction, particularly water passages and air passages, of the washing/drying machine 1 will be described in detail with reference to FIG. 4.

Arrangement of Water Passages and Air Passages of Washing/Drying Machine

Figure 4:
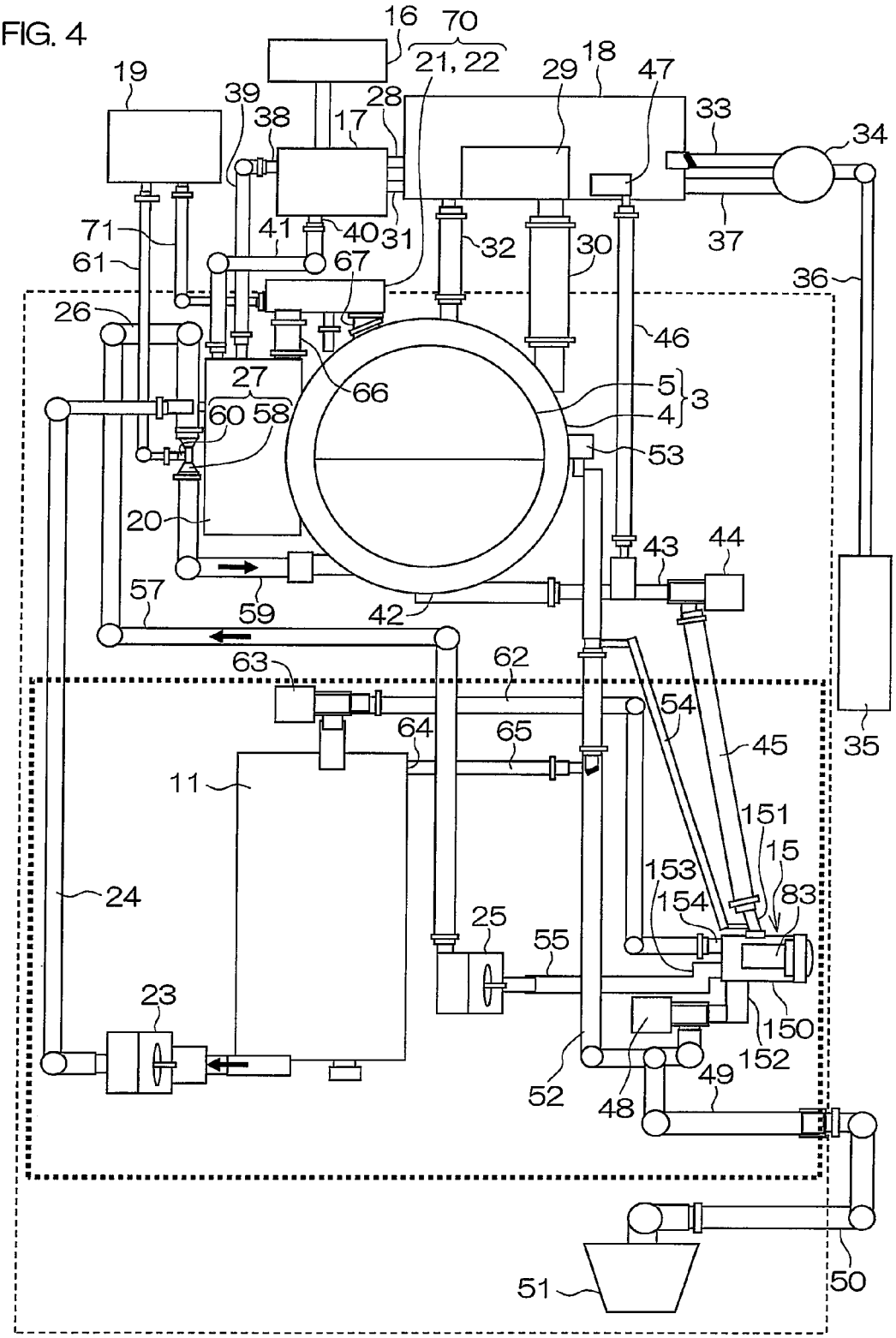
FIG. 4 is a schematic diagram mainly illustrating water passages and air passages of the washing/drying machine 1.

FIG. 4 is a schematic diagram mainly illustrating the water passages and the air passages of the washing/drying machine 1.

The water plug 16 is connected to an inlet of the water supply valve 17. The water supply valve 17 has four outlets through which the water is selectively caused to flow out. A first outlet port 28 of the water supply valve 17 is connected to the water supply port unit 18. Though not shown, the water supply port unit 18 includes a two-branch water passage having a water passage for guiding water supplied from the first outlet port 28 into a water supply passage 32 and a water passage for guiding the water supplied from the first outlet port 28 into a priming water passage 33. The water supplied into the water supply port unit 18 from the first outlet port 28 flows into the detergent container 29 mainly through the priming water passage 33, a bathwater pump 34 and a water passage 37. Then, the water flows through a detergent containing chamber defined in the detergent container 29 and then into the washing tub 3 through a water supply passage 30. A part of the water flowing into the water supply passage 32 through the branch water passage further flows over an inner surface of the door 10 (see FIG. 1) into the washing tub 3 from an upper portion of the door 10 provided on a front face of the washing tub 3. A second outlet port 31 of the water supply valve 17 is connected to the water supply port unit 18, and water supplied from the second outlet port 31 flows through a softener containing chamber defined in the detergent container 29 and then into the washing tub 3 through the water supply passage 30.

When the bathwater pump 34 is driven, on the other hand, bathwater in a bathtub 35 is pumped up into the water supply port unit 18 through the water passage 37, and flows through the detergent containing chamber of the detergent container 29 to be supplied into the washing tub 3 through the water supply passage 30.

A third outlet port 38 of the water supply valve 17 is connected to a predetermined portion of the drying air duct 20 via a water passage 39. A fourth outlet port 40 of the water supply valve 17 is connected to a predetermined portion of the drying air duct 20 via a water passage 41. The third outlet port 38 has a relatively small diameter, while the fourth outlet port 40 has a relatively great diameter. With the third outlet port 38 being open, therefore, a relatively small amount of water is supplied into the drying air duct 20 through the water passage 39. This water is brought into contact with the circulated high-temperature high-humidity air in the drying air duct 20 for the heat exchange. With the fourth outlet port 40 being open, a relatively great amount of water is supplied into the drying air duct 20 through the water passage 41. This water is used for washing away lint and other foreign matter contained in the air circulated upward in the drying air duct 20 and for washing away lint and other foreign matter adhering to an inner wall of the drying air duct 20.

In the laundry process (the washing step or the rinsing step), water is retained in the washing tub 3. A drain port 42 is provided in a lowermost bottom portion of the washing tub 3 (more specifically, in a lowermost bottom portion of the outer tub 4). An inlet port of a first drain valve 44 is connected to the drain port 42 via a water passage 43, and an outlet port of the first drain valve 44 is connected to an inlet port 151 of the filter unit 15 via a water passage 45. With the first drain valve 44 being closed, water can be retained in the washing tub 3 (outer tub 4). A water level in the washing tub 3 is detected by a water level sensor 47 based on a change in pressure in an air hose 46 branched from the water passage 43 and extending upward.

The filter unit 15 includes a case 150, and a filter body 83 accommodated in the case 150 for trapping foreign matter. The case 150 has a drain port 152, a first outlet port 153 and a second outlet port 154 in addition to the aforementioned inlet port 151. An inlet port of a second drain valve 48 is connected to the drain port 152, and an outlet port of the second drain valve 48 is connected to an external drain hose 50 and a drain trap 51 via a water passage 49. With the first drain valve 44 and the second drain valve 48 being open, the water in the washing tub 3 is drained into the drain trap 51 through the drain port 42, the water passage 43, the first drain valve 44, the water passage 45, the filter unit 15, the drain port 152, the second drain valve 48, the water passage 49 and the external drain hose 50. One end (lower end) of an overflow water passage 52 is connected to the water passage 49. The other end (upper end) of the overflow water passage 52 communicates with an overflow port 53 of the outer tub 4. Therefore, if water is retained in the washing tub 3 in excess to a water level not lower than a predetermined level, water overflows from the overflow port 53, and drained into the drain trap 51 through the overflow water passage 52, the water passage 49 and the external drain hose 50 irrespective of the opening/closing state of the second drain valve 48.

An air pressure adjusting hose 54 is connected to a vertically middle portion of the overflow water passage 52 and the inlet port 151 of the filter unit 15. With the provision of the hose 54, the internal air pressure of the washing tub 3 is equal to an air pressure on the side of the inlet port 151 of the filter unit 15, thereby preventing the back flow of water in the filter unit 15 and other trouble.

One end of a first water circulation passage 55 is connected to the first outlet port 153 of the filter unit 15, and the other end of the first water circulation passage 55 is connected to a suction port of the circulation pump 25. One end of the second water circulation passage 57 is connected to an outlet port of the circulation pump 25. The second water circulation passage 57 extends upward to a position higher than an ordinary water level up to which the water is retained in the washing tub 3, and the other end of the second water circulation passage 57 is connected to a U-turn portion 26 which is U-turned from an upward direction to a downward direction. An upper end of a venturi tube 58 of the gas-liquid mixer 27 is connected to the U-turn portion 26. One end (upper end) of a third water circulation passage 59 is connected to a lower end of the venturi tube 58, and the other end (lower end) of the third water circulation passage 59 is connected to the lower portion of the rear face of the washing tub 3 (outer tub 4).

With the aforementioned arrangement, a predetermined amount of water is retained in the washing tub 3, and the circulation pump 25 is driven with the first drain valve 44 being open and with the second drain valve 48 being closed in the washing step and/or the rinsing step, whereby the water retained in the washing tub 3 is circulated from the drain port 42 through the water passage 43, the first drain valve 44, the water passage 45, the inlet port 151, the case 150, the first outlet port 153, the first water circulation passage 55, the circulation pump 25, the second water circulation passage 57, the U-turn portion 26, the venturi tube 58 and the third water circulation passage 59 into the washing tub 3.

The venturi tube 58 has an air inlet port 60, and the ozone generator 19 is connected to the air inlet port 60 via an air tube 61. If the ozone generator 19 is actuated when water flows through the venturi tube 58, the cleaning air containing the ozone generated by the ozone generator 19 flows through the air tube 61 and then into the venturi tube 58 through the air inlet port 60. A fundamental reason for the flow of the cleaning air into the venturi tube 58 is that there is a pressure difference (negative pressure) caused by the water flowing through the venturi tube 58. When the ozone is mixed with the circulated water, the circulated water is cleaned by the strong oxidation power and the sterilization power of the ozone. Thus, the laundry process can be performed in the washing tub 3 with the use of the cleaned water.

One end (upper end) of a storage water passage 62 is connected to the second outlet port 154 of the filter unit 15, and the other end (lower end) of the storage water passage 62 is connected to an inlet port of a water storage valve 63. An outlet port of the water storage valve 63 is connected to the tank 11. When the water storage valve 63 is opened with the first drain valve 44 being open, with the second drain valve 48 being closed and with the circulation pump 25 being deactuated after the completion of the rinsing step, for example, the water used for the rinsing operation and retained in the washing tub 3 flows into the tank 11 from the drain port 42 through the water passage 43, the first drain valve 44, the water passage 45, the inlet port 151, the case 150, the second outlet port 154, the storage water passage 62 and the water storage valve 63 by gravity (natural falling). Thus, the water used for the rinsing operation is stored as recycling water in the tank 11.

An overflow port 64 is provided at an upper portion of the tank 11. One end of a water passage 65 is connected to the overflow port 64, and the other end of the water passage 65 is connected to a middle portion of the overflow water passage 52. If water is retained in the tank 11 to a water level not lower than a predetermined level, the water overflows to the drain trap 51 from the overflow port 64 through the water passage 65, the overflow water passage 52, the water passage 49 and the external drain hose 50.

In the washing/drying machine 1, the used water is retained in the tank 11, and reused as the recycling water in the drying process.

The washing/drying machine 1 includes the drying air duct 20 for a drying function. The drying air duct 20 is disposed outside the washing tub 3 (outer tub 4). The drying air duct 20 is an air duct through which air sucked out of the washing tub 3 through the lower portion of the rear face of the outer tub 4 is circulated to flow into the washing tub 3 from a front upper portion of the outer tub 4. The drying air duct 20 includes a connection pipe 66, a filter blower unit 70 (including the blower 21 and the drying filter unit 22), and a connection pipe 67. As described with reference to FIG. 1, the drying heater A 124 and the drying heater B 125 (not shown) are provided in the air duct extending from the filter blower unit 70 to the connection pipe 67 for heating the circulated air. For example, semiconductor heaters may be used as the drying heaters.

The air sucked out of the washing tub 3 is dehumidified in the drying air duct 20. Further, the foreign matter such as lint contained in the air circulated through the drying air duct 20 and the foreign matter adhering to the inner wall of the drying air duct 20 are washed away. Therefore, the recycling water retained in the tank 11 is circulated to flow through the drying air duct 20.

A suction port of the drying pump 23 is connected to the tank 11. One end of the duct water supply passage 24 is connected to an outlet port of the drying pump 23, and the other end of the duct water supply passage 24 is connected to the first position of the drying air duct 20. In the drying process, water flows through the duct water supply passage 24 to be supplied into the drying air duct 20 from the first position of the drying air duct 20 upon actuation of the drying pump 23. As described above, the supplied water is heat-exchanged with the air circulated upward from the lower side in the drying air duct 20, and washes away the lint and other foreign matter contained in the air and the foreign matter adhering to the inner wall of the drying air duct 20. Water flowing down together with the lint and other foreign matter in the drying air duct 20 further flows into the filter unit 15 from the lower portion of the outer tub 4 through the drain port 42, the water passage 43, the first drain valve 44 and the water passage 45. Then, the lint and other foreign matter are trapped and filtered away in the filter unit 15, and water free from the foreign matter flows back into the tank 11 from the second outlet port 154 through the storage water passage 62 and the water storage valve 63.

The washing/drying machine may be configured such that the water flowing down in the drying air duct 20 is drained, for example, from a lower end (second position) of the drying air duct 20 and flows back into the tank 11 rather than into the outer tub 4.

In the drying process, a great amount of water is required for the heat exchange in the drying air duct 20 and for the removal of the lint and other foreign matter adhering to the inner wall of the drying air duct 20. The washing/drying machine 1 is configured such that the used water stored in the tank 11 is recycled for use as the water required for the heat exchange and the removal of the foreign matter. Thus, drastic water saving can be achieved. Since the water is circulated from the tank 11, the volume of the tank 11 is reduced. Even with the provision of the tank 11, the outer size of the washing/drying machine is not increased.

The ozone generator 19 is connected to the filter blower unit 70 via an air tube 71. In the drying process, the cleaning air containing the ozone generated by the ozone generator 19 is sucked into the filter blower unit 70 upon actuation of the ozone generator 19, and mixed with the air to be circulated into the washing tub 3. As a result, the garment to be dried can be deodorized and sterilized.

Configuration of Water Circulation Passage

Figure 5:
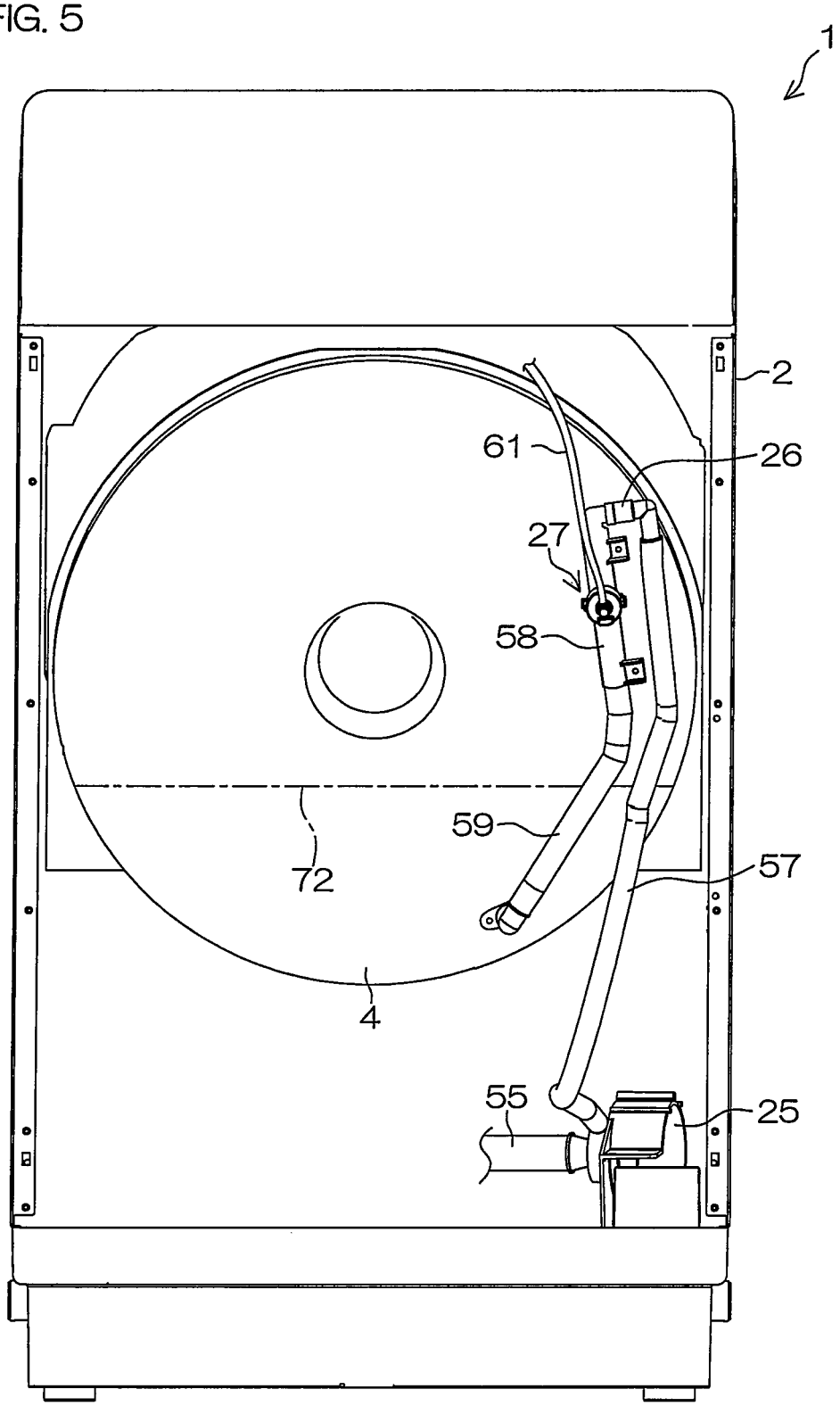
FIG. 5 is a rear view of the washing/drying machine 1 for explaining a water circulation passage structure including a first water circulation passage 55, a circulation pump 25, a second water circulation passage 57, a U-turn portion 26, a gas-liquid mixer 27 (venturi tube 58) and a third water circulation pipe 59.

FIG. 5 is a rear view of the washing/drying machine 1 for explaining a water circulation passage structure including the first water circulation passage 55, the circulation pump 25, the second water circulation passage 57, the U-turn portion 26, the gas-liquid mixer 27 (venturi tube 58) and the third water circulation pipe 59. In FIG. 5, only components required for the explanation are shown.

Water resulting from the filtering by the filter unit 15 (see FIG. 4) is sucked into the circulation pump 25 through the first water circulation passage 55 and ejected into the second water circulation passage 57 by driving the circulation pump 25. The second water circulation passage 57 extends upward from the lower side to guide the water to the position higher than the ordinary water level (indicated by a one-dot-and-dash line 72) up to which the water is retained in the outer tub 4. The water flows into the gas-liquid mixer 27 with its flow direction reversed from the upward direction to the downward direction by the U-turn portion 26. Thus, the water flows down from the upper side in the gas-liquid mixer 27. The gas-liquid mixer 27 is also disposed at a position higher than the ordinary water level 72 up to which the water is retained in the outer tub 4. Therefore, the flow direction of the water pumped into the second water circulation passage 57 by the circulation pump 25 is reversed at the position higher than the water level 72. Thus, the water swiftly flows down through the gas-liquid mixer 27, because the water falls down from the position higher than the water level 72 through the gas-liquid mixer 27. Then, the water flows through the third water circulation passage 59, and then into the outer tub 4 from the lower portion of the rear face of the outer tub 4.

The water circulation passage structure includes the second water circulation passage 57 for guiding the water to the position higher than the water level 72 in the outer tub 4, and the U-turn portion 26 for reversing the flow direction of the water guided upward. Therefore, the gas-liquid mixer 27 can be located at the position higher than the water level 72 in the outer tub 4. In addition, the gas-liquid mixer 27 can be disposed as extending vertically. Thus, a water pressure occurring due to the water level 72 does not hinder the flow of the water in the gas-liquid mixer 27, but the water swiftly flows down from the upper side due to the pumping force of the circulation pump 25 as well as the gravity. As a result, a negative pressure occurs in the flow passage, so that the ozone-containing cleaning air can be efficiently mixed with the water in the gas-liquid mixer 27.

Further, the water falling down through the gas-liquid mixer 27 is guided downward through the third water circulation passage 59, and circulated into the outer tub 4 from the lower portion of the rear face of the outer tub 4. The circulated water, which contains minute bubbles of the ozone-containing cleaning air, flows back into the washing tub 3 from the lower portion of the outer tub 4. Thus, the minute bubbles of the cleaning air contained in the water move upward from the lower side in the washing tub 3, whereby the garment is efficiently cleaned, sterilized and deodorized in the washing tub 3.

The third water circulation passage 59 is not necessarily required to extend to the lower portion of the outer tub 4, but may be configured to cause the water to flow into the outer tub 4 from a vertically middle portion of the rear face of the outer tub 4 for the circulate.

A reference numeral 61 denotes the air tube. The ozone-containing cleaning air is supplied into the gas-liquid mixer 27 through the air tube 61.

Structures of U-Turn Portion and Gas-Liquid Mixer

Figure 6:
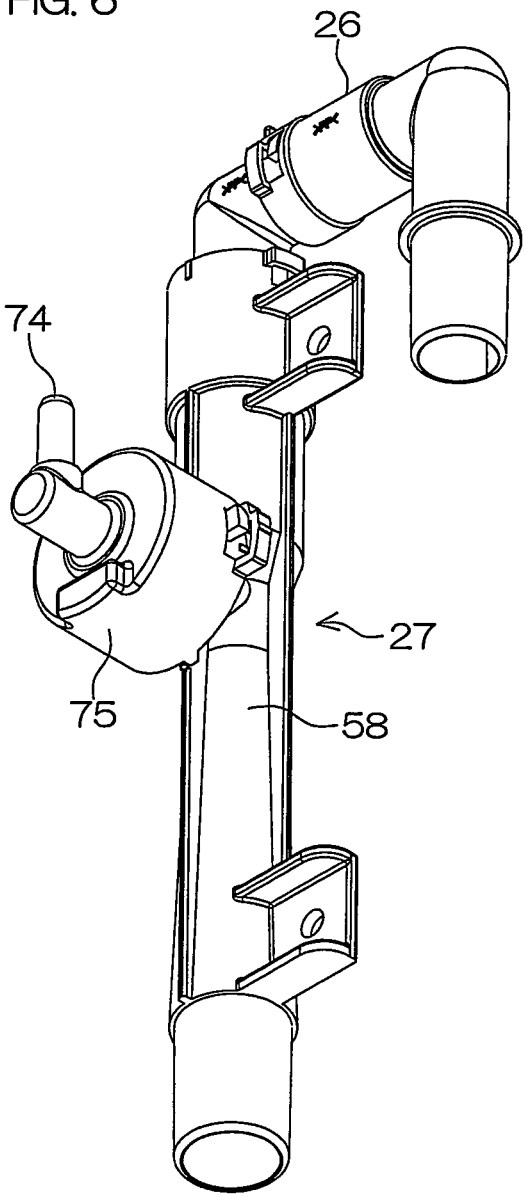
FIG. 6 is a perspective view showing specific structures of the U-turn portion 26 and the gas-liquid mixer 27.

FIG. 6 is a perspective view showing specific structures of the U-turn portion 26 and the gas-liquid mixer 27. In this embodiment, the U-turn portion 26 and the gas-liquid mixer 27 are provided by connecting resin pipes to each other. The gas-liquid mixer 27 includes a venturi tube 58, an air intake port 74 and a buffer chamber 75.

Figure 7:
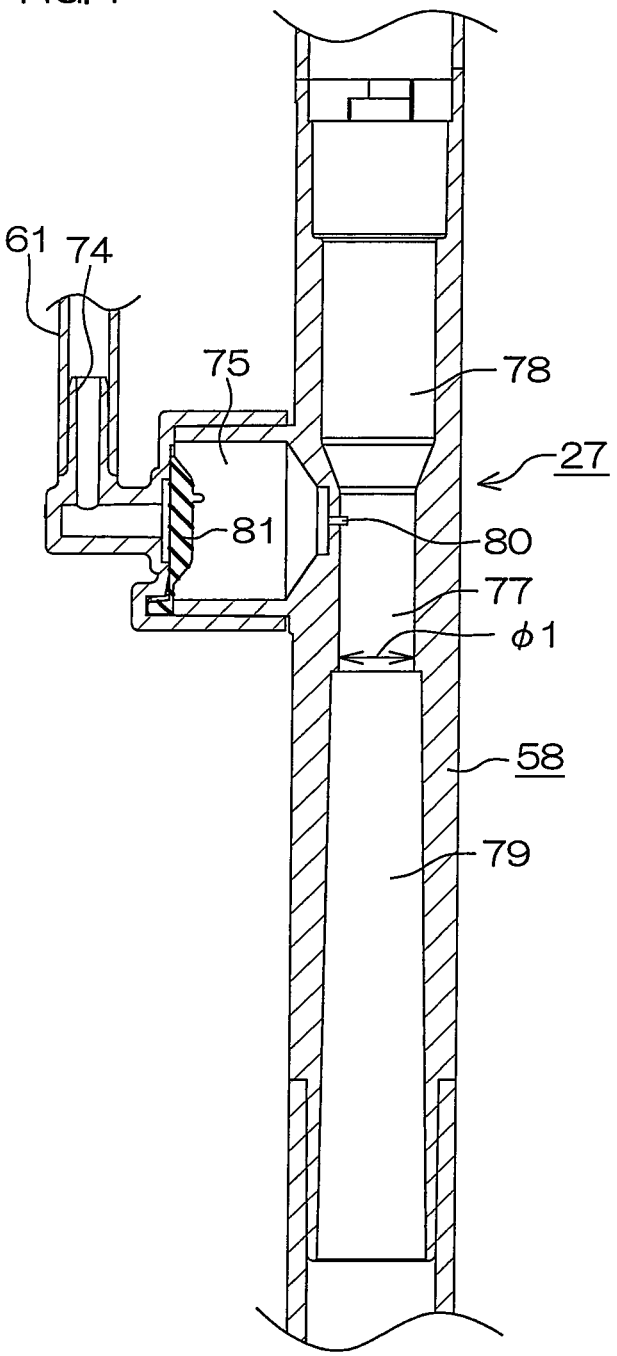
FIG. 7 is a vertical sectional view showing the internal structure of the gas-liquid mixer 27.

FIG. 7 is a vertical sectional view showing the internal structure of the gas-liquid mixer 27. As described above, the gas-liquid mixer 27 includes the venturi tube 58. The venturi tube 58 extends vertically, and includes three types of flow passages having different flow passage diameters and connected to one another, i.e., an upstream flow passage 78 provided on an upper side and having a greater flow passage diameter, a restrictive flow passage 77 provided on a lower side of the upstream flow passage 78 and having a smaller flow passage diameter, and a downstream flow passage 79 provided on a lower side of the restrictive flow passage 77 and having a progressively increased flow passage diameter. When the water flows through the upstream flow passage 78, the restrictive flow passage 77 and the downstream flow passage 79, the speed (flow rate) of the water flowing through the restrictive flow passage 77 is increased. Further, an inner wall of the restrictive flow passage 77 is formed with a small hole 80 for air intake. The small hole 80 communicates with the buffer chamber 75 connected to an outer surface of the venturi tube 58. Air is supplied into the buffer chamber 75 from the air intake port 74. A check valve 81 such as of a rubber is disposed at an inlet of the buffer chamber 75. The check valve 81 permits the flow of the air into the buffer chamber 75 from the air intake port 74, but prevents the flow of gas and liquid from the inside of the buffer chamber 75 to the air intake port 74.

The water falling down from the U-turn portion 26 swiftly flows into the upstream flow passage 78, and its flow rate is increased in the restrictive flow passage 77. Therefore, a negative pressure occurs to permit the air intake from the buffer chamber 75 through the air intake hole 80. The negative pressure causes the ozone-containing cleaning air to flow into the restrictive flow passage 77 from the buffer chamber 75 through the air intake hole 80, whereby the cleaning air is mixed in the form of minute air bubbles with the flowing water.

There is a possibility that, when the water flow in the restrictive flow passage 77 is stopped, the water would flow into the buffer chamber 75 through the air intake hole 80 and further flow back to the ozone generator 19 (see FIG. 4) from the air intake port 74. In this embodiment, however, the check valve 81 is provided in the buffer chamber 75. As a result, the ozone generator 19 is free from any inconvenience, which may otherwise occur due to water flowing back through the air tube 61. Further, there is a possibility that, in the drying process, steam would flow into the third water circulation passage 59 from the washing tub 3, then flow through the venturi tube 58 and then into the buffer chamber 75 from the air intake hole 80, and further flow back into the ozone generator 19 from the air intake port 74. However, the back flow of the steam in the drying process is also prevented by the check valve 81.

In this embodiment, the inner diameter of the restrictive flow passage 77 is $\phi$=8 mm. As will be described later, the inner diameter $\phi$ is greater than a filter mesh diameter of the filter unit 15. As a result, there is no fear that the restrictive flow passage 77 would be clogged with foreign matter such as lint contained in the flowing water.

Structure of Filter Unit

Next, the structure of the filter unit 15 will be described.

As described with reference to FIG. 2, the filter unit 15 is provided in the front lower right portion of the washing/drying machine 1. The filter unit 15 includes the case 150, the inlet port 151, the drain port 152, the first outlet port 153 and the second outlet port 154 as described with reference to FIG. 4.

Figure 8:
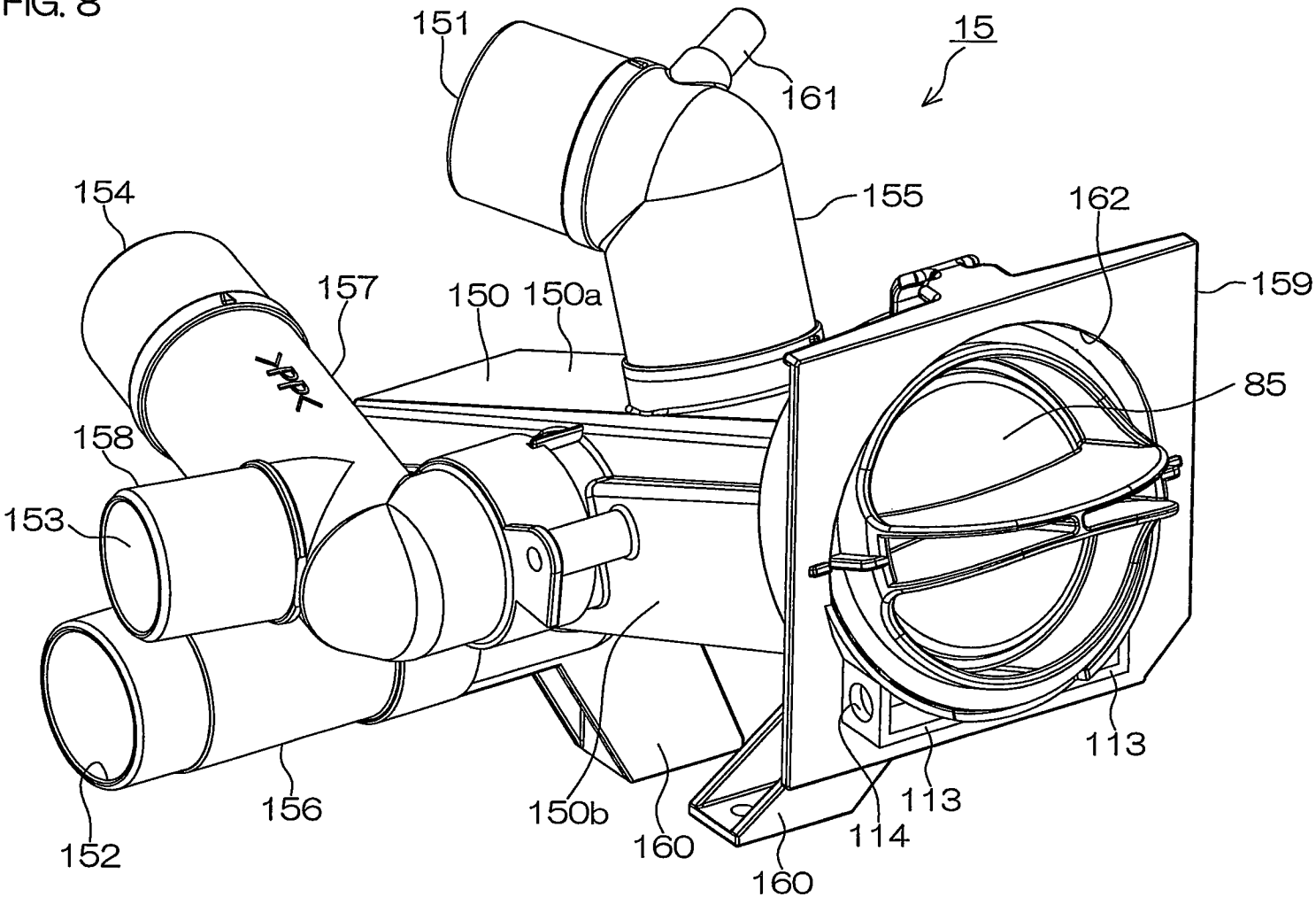
FIG. 8 is a perspective view of a filter unit 15.

FIG. 8 is a perspective view illustrating the filter unit 15 as seen obliquely from the front side of the washing/drying machine 1.

Referring to FIG. 8, the filter unit 15 includes the case 150, an inlet pipe 155, a drain pipe 156, outlet pipes 157, 158, a front fixture plate 159 and fixture legs 160. These components are composed of a resin (e.g., polypropylene). The front fixture plate 159 and the fixture legs 160 are formed integrally with the case 150, and the drain pipe 156, the inlet pipe 155 and the outlet pipes 157, 158 which are separately formed are liquid-tightly connected to the case 150.

With the front fixture plate 159 and the fixture legs 160 attached to the housing 2 of the washing/drying machine 1, the case 150 has an elongated shape extending obliquely downward rearward from the front side. The case 150 has a hole (not shown) provided in an upper surface 150*a* thereof, and the inlet pipe 155 is attached to the upper surface 150*a* for communication with the hole. As described with reference to FIG. 4, the water passage 45 is connected to an upper open end of the inlet pipe 155 serving as the inlet port 151. The hose 54 described with reference to FIG. 4 is connected to a tubular projection 161 projecting from a middle portion of the inlet pipe 155.

The case 150 has right and left side surfaces and a bottom surface which collectively define a seamless case lateral/bottom surface 150*b* arcuately bulged downward.

The drain pipe 156 projects laterally from the case lateral/bottom surface 150*b* in a direction crossing a longitudinal axis of the case 150, more specifically perpendicularly to the longitudinal axis of the case 150, and its distal end serves as the drain port 152. The drain pipe 156 projects from an innermost longitudinal end portion of the case 150 (from a lower end portion of the obliquely extending case 150).

The outlet pipe 157 has a longitudinally middle portion which is generally perpendicularly bent, and is fixed to a portion of the case 150 intermediate between a fixing position of the inlet pipe 155 and a fixing position of the drain pipe 156 as seen longitudinally of the case 150. The outlet pipe 157 is fixed to the case 150 as projecting laterally from the lateral/bottom surface 150*b* of the case 150, and a distal end of the portion bent at about 90 degrees is defined as the second outlet port 154. The outlet pipe 158 is connected to the outlet pipe 157 as being branched from the outlet pipe 157, and a distal end of the pipe 158 is defined as the first outlet port 153. As described with reference to FIG. 4, the suction port of the second drain valve 48, the first water circulation passage 55 and the storage water passage 62 are connected to the drain port 152, the first outlet port 153 and the second outlet port 154, respectively.

The front fixture plate 159 has a filter insertion port 162. The filter insertion port 162 communicates with the inside space of the case 150. The filter body 83 (see FIG. 9) is inserted into the case 150 through the filter insertion port 162, and an operable lid 85 is turned to a state as shown in FIG. 8. In this state, the filter unit 15 can function normally.

Ribs 113 are provided on the front fixture plate 159 on lower opposite sides of the filter insertion port 162 as projecting forward. The ribs 113 respectively have engagement holes 114 in which a movable member is rotatably fitted.

Figure 9:
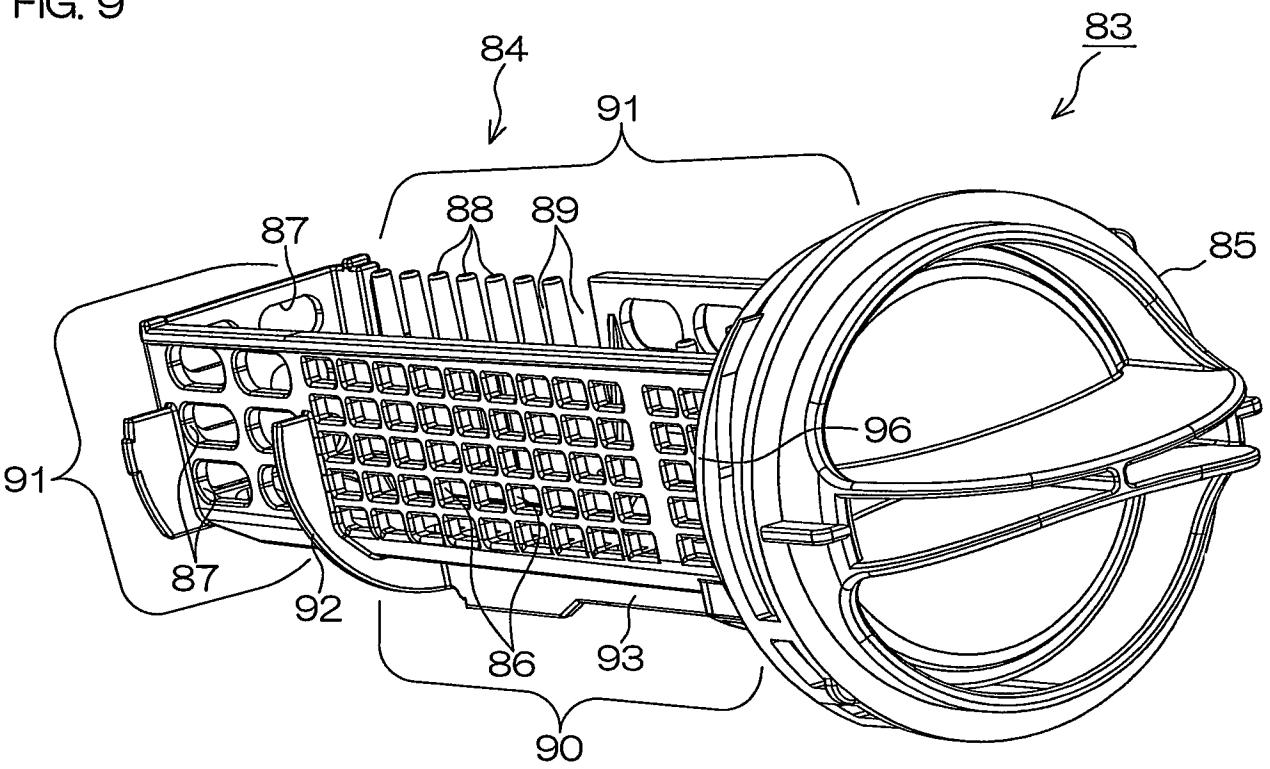
FIG. 9 is a perspective view showing the structure of a filter body 83.

FIG. 9 is a perspective view showing the structure of the filter body 83. The filter body 83 includes a basket 84 serving as a filter material, and the operable lid 85. The basket 84 is composed of a resin, and has an open top, and a multiplicity of filtering holes and filtering slits formed in a predetermined arrangement in side walls and a bottom wall thereof.

Figure 10:
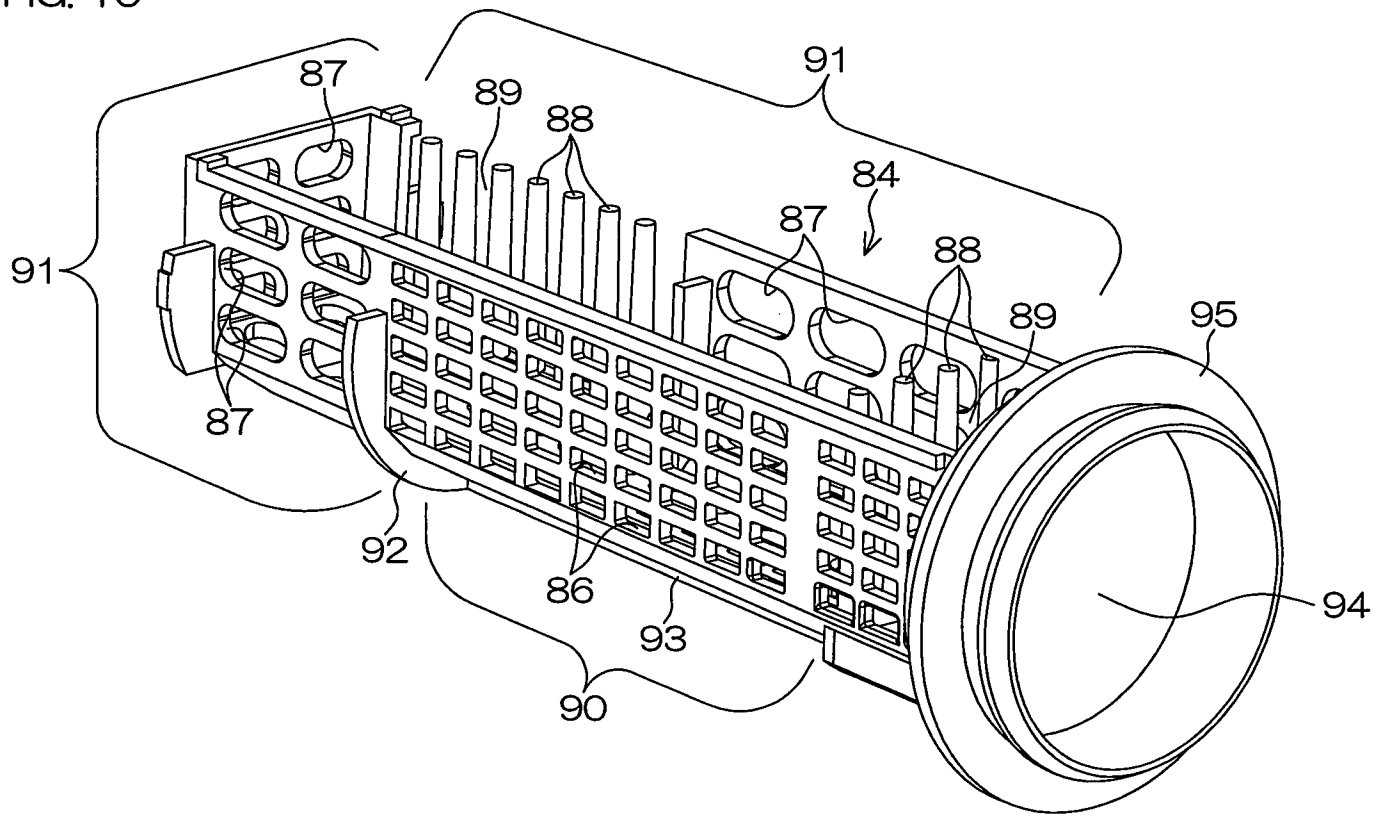
FIG. 10 is a perspective view showing the structure of a basket 84 with an operable lid 85 removed from the filter body 83.

FIG. 10 is a perspective view showing the structure of the basket 84 with the operable lid 85 removed from the filter body 83.

Referring to FIGS. 9 and 10, the filtering holes of the basket 84 include smaller filtering holes 86 each having a size (maximum diameter) not greater than a predetermined level, larger filtering holes 87 each having a greater size, and slits 89 defined between comb-like rods 88. The smaller filtering holes 86 are provided in front portions of the left side wall and the bottom wall of the basket 84. The wall portions formed with the smaller filtering holes 86 are collectively defined as a recycling water filtering wall portion 90. On the other hand, a rear portion of the left side wall, a rear wall, a portion of the bottom wall and a portion of the right side wall of the basket 84 formed with the larger filtering holes 87, and a wall portion of the basket 84 having the slits 89 defined between the rods 88 are collectively defined as a drain water filtering wall portion 91. Partitioning ribs 92, 93 are provided along a boundary between the recycling water filtering wall portion 90 and the drain water filtering wall portion 91 as projecting from an outer surface of the basket 84.

A front face of the basket 84 is closed with a sealing wall 94, and an annular flange 95 projects from the periphery of the sealing wall 94 (see FIG. 10).

As shown in FIG. 9, the operable lid 85 is rotatably fitted on the flange 95 shown in FIG. 10. The operable lid 85 and the basket 84 are rotatable relative to each other. A seal ring 96 such as of a rubber is provided on a rear peripheral surface of the operable lid 85. The basket 84 of the filter body 83 is inserted into the case 150 from the filter insertion port 162 shown in FIG. 8. After the insertion, the operable lid 85 is turned, whereby a gap between the filter insertion port 162 and the operable lid 85 is liquid-tightly sealed by the seal ring 96. Thus, the filter body 83 is completely fixed to the case 150. The inner wall of the case 150 has a specific configuration such that the basket 84 can be accommodated in a predetermined orientation in the case 150.

Figure 11:
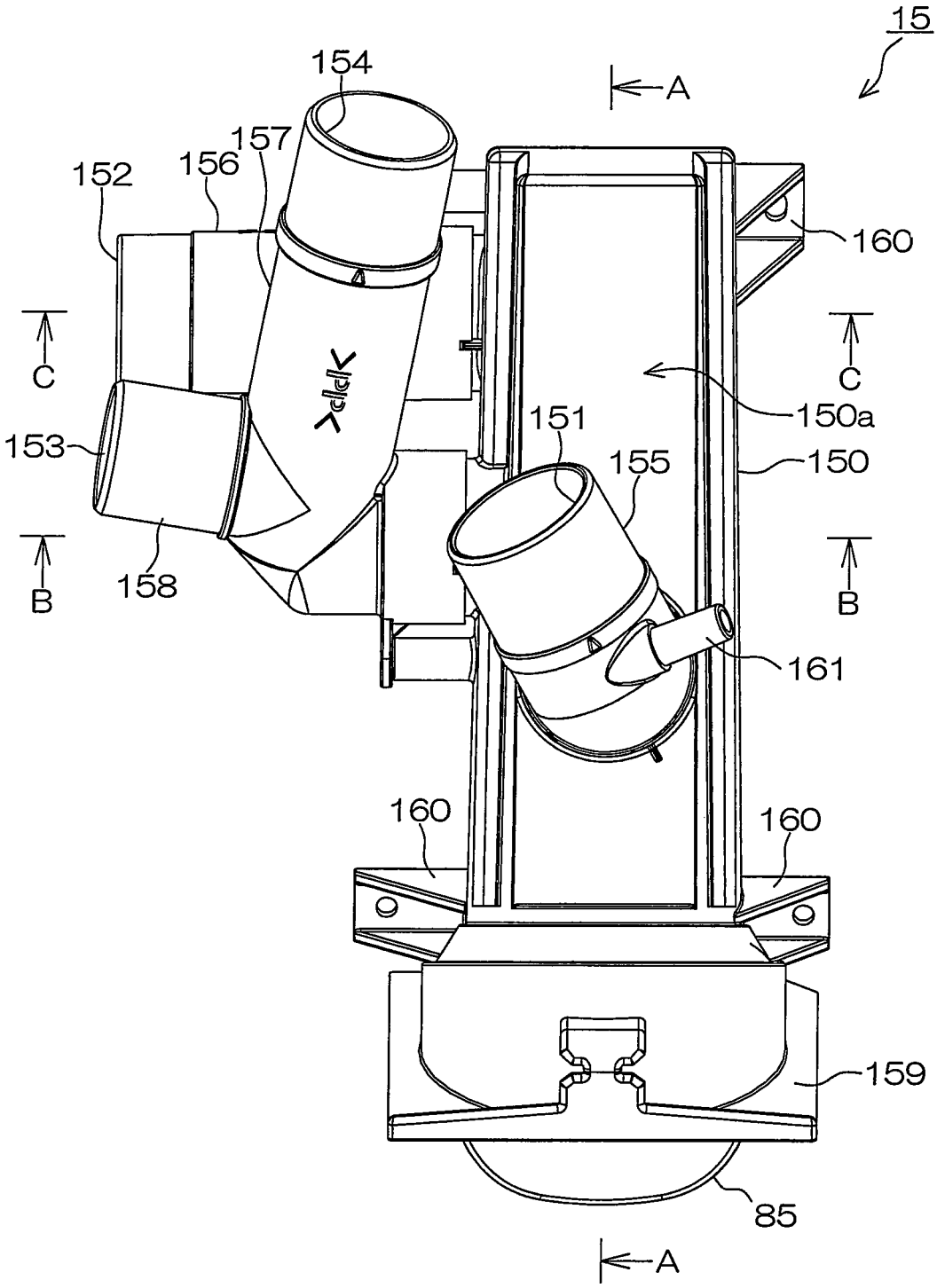
FIG. 11 is a plan view of the filter unit 15.
Figure 12:
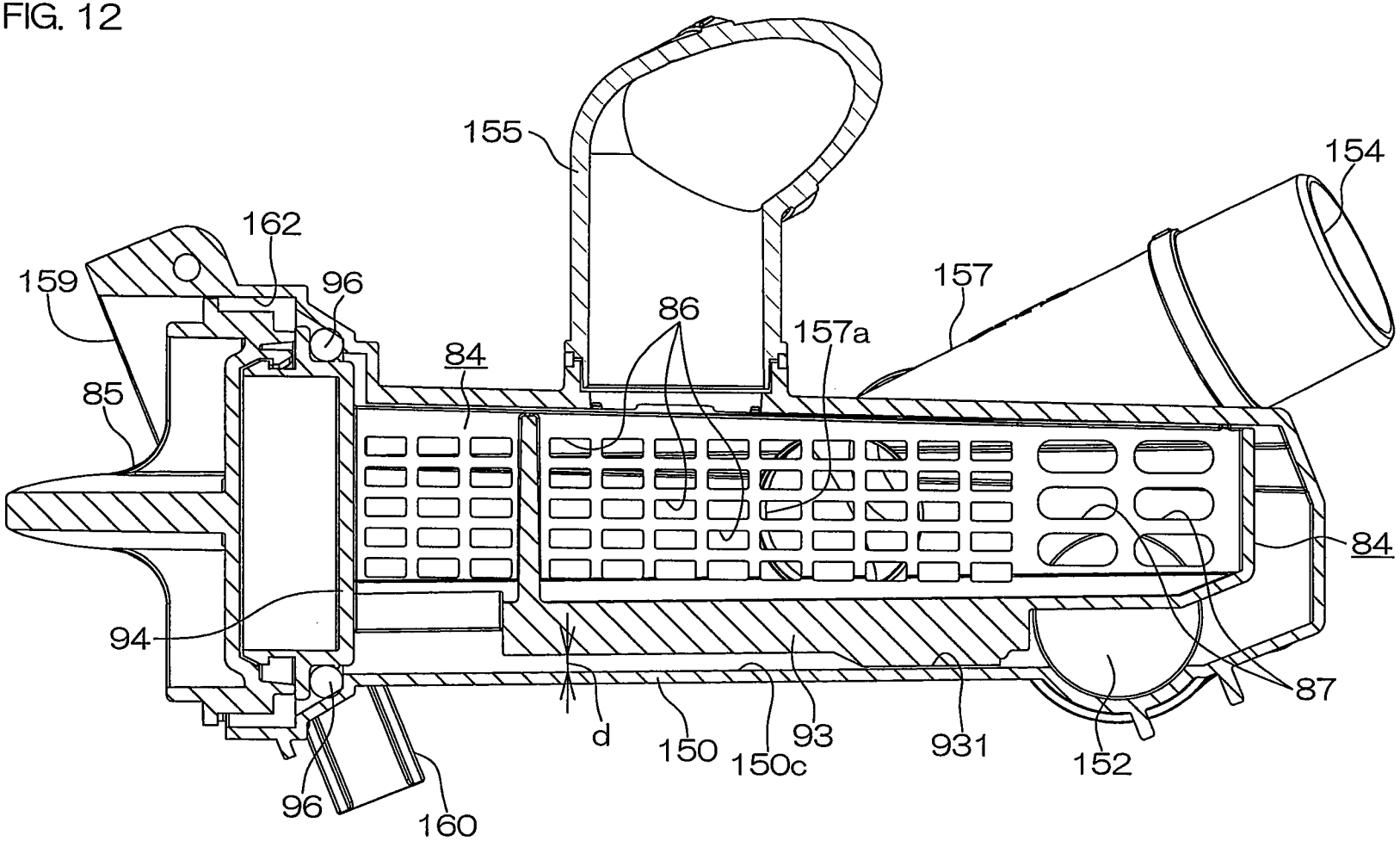
FIG. 12 is a longitudinal sectional view of the filter unit 15 taken along a line A-A in FIG. 11.
Figure 13:
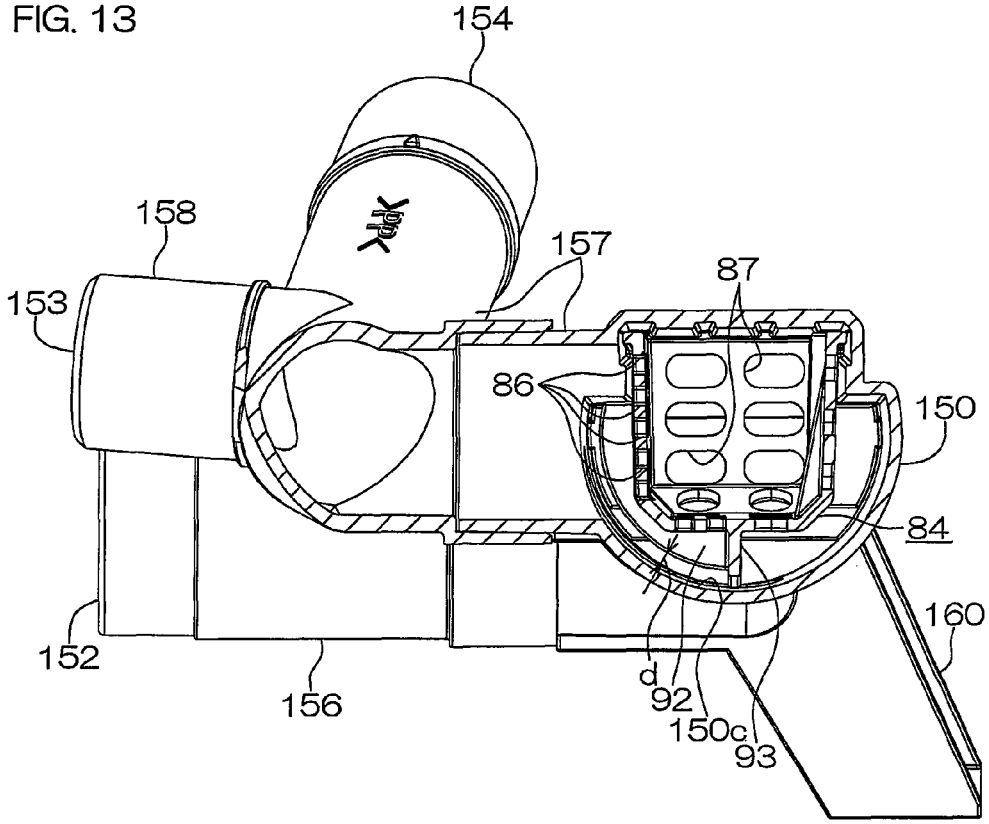
FIG. 13 is a transverse sectional view of the filter unit 15 taken along a line B-B in FIG. 11.
Figure 14:
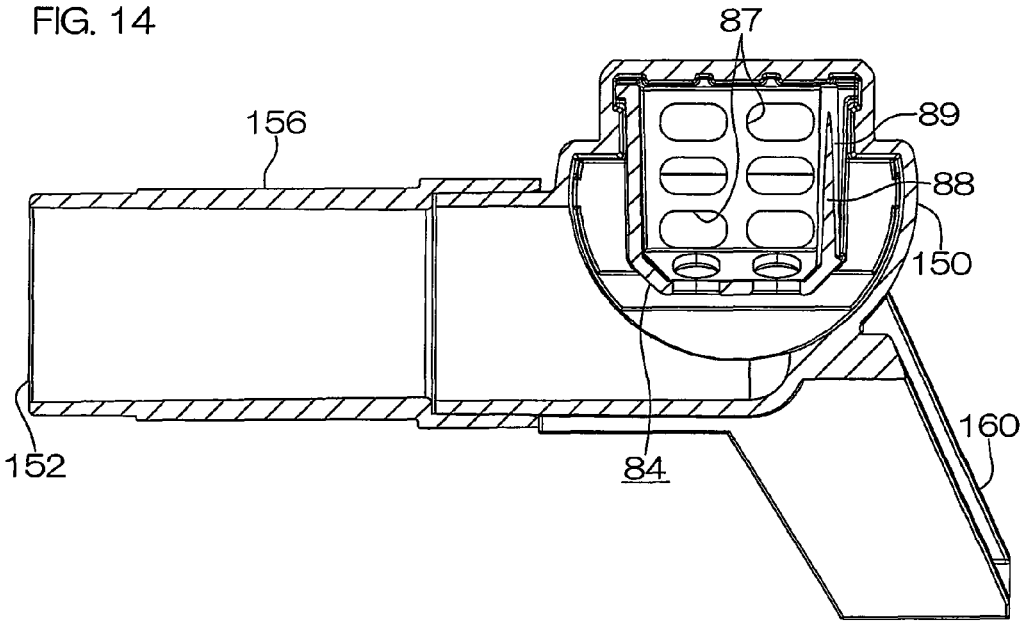
FIG. 14 is a transverse sectional view of the filter unit 15 taken along a line C-C in FIG. 11.

FIG. 11 is a plan view of the filter unit 15. FIG. 12 is a longitudinal sectional view of the filter unit 15 taken along a line A-A in FIG. 11. FIG. 13 is a transverse sectional view of the filter unit 15 taken along a line B-B in FIG. 11. FIG. 14 is a transverse sectional view of the filter unit 15 taken along a line C-C in FIG. 11.

As shown in FIG. 12, the rib 93 is provided on the basket 84 as projecting downward from the bottom wall and extending anteroposteriorly (longitudinally of the case 150). The rib 93 is configured so that the basket 84 set in the case 150 is spaced a distance d (mm) (which is not greater than the size (maximum diameter) of the smaller filtering holes) from an inner bottom surface 150*c* of the case 150. A part 931 of the rib 93 is brought into contact with the inner bottom surface 150*c* of the case 150, thereby functioning to position the basket 84 in the case 150. Where larger-size foreign matter is present in water flowing outside the basket 84 through the larger filtering holes 87 and the slits 89 (see FIG. 10) formed in the drain water filtering wall portion 91 present on the front side in FIG. 12 and further flowing into an inlet port 157*a* of the outlet pipe 157 through a space defined between a lower surface of the basket 84 and the inner bottom surface 150*c* of the case 150, the rib 93 prevents the foreign matter from flowing into the inlet port 157*a* of the outlet pipe 157.

Referring next to FIG. 13, the rib 92 projecting from the outer surface of the basket 84 spaces the basket 84 a predetermined distance d (mm) (which is not greater than the size (maximum diameter) of the smaller filtering holes) from the inner side surface and the inner bottom surface 150*c* of the case with the filter body 83 being set in the case 150. Therefore, where larger-size foreign matter is present in water flowing outside the basket 84 through the larger filtering holes 87 formed, for example, in the rear portion of the side wall of the basket 84 and further flowing forward into the outlet pipe 157 through a space defined between the basket 84 and the inner side surface or the inner bottom surface 150*c* of the case 150, the rib 92 prevents the foreign matter from flowing into the outlet pipe 157.

Thus, the ribs 92, 93 are provided as surrounding the recycling water filtering wall portion 90 formed with the smaller filtering holes 86. The ribs 92, 93 are opposed to the inner surfaces of the case 150 so as not to form a gap larger than the size of the smaller filtering holes 86 around the recycling water filtering wall portion 90. Thus, the water flowing into the basket 84 is filtered through the recycling water filtering wall portion 90 formed with the smaller filtering holes 86, and the water flowing through the recycling water filtering wall portion 90 and the water flowing through the gap defined between the ribs 92, 93 and the inner surfaces of the case 150 are permitted to flow into the outlet pipe 150. Thus, the water flowing into the outlet pipe 157 does not contain foreign matter greater in size than the smaller filtering holes 86.

The size (maximum diameter) of the smaller filtering holes 86 is set smaller than the inner diameter of the restrictive flow passage 77 of the venturi tube 58 of the gas-liquid mixer 27, so that foreign matter greater in size than the inner diameter $\phi$ of the restrictive flow passage 77 is not present in the water flowing through the venturi tube 58. This prevents slow-down or stop of the water flow in the venturi tube 58, which may otherwise occur when the restrictive flow passage 77 having a reduced flow diameter is clogged with the foreign matter.

As shown in FIG. 14, water flows out of the drain pipe 156 after being filtered through the larger filtering holes 87 and the slits 89 of the basket 84, so that greater size foreign matter does not flow out through the drain pipe 156. This eliminates the possibility of clogging of the drain port.

As apparent from FIGS. 8 to 14, the case 150 of the filter unit 15 has an elongated shape extending obliquely downward rearward from the front, and the basket 84 of the filter body 83 is accommodated in the case 150. The outlet pipe 157 is located forward of the drain pipe 156, i.e., is attached to the case 150 at a higher position than the drain pipe 156. As shown in FIGS. 9 and 10, the recycling water filtering wall portion 90 is located on a forward (upper) side, while the drain water filtering wall portion 91 is located on a rearward (lower) side. Therefore, if foreign matter is contained in the water flowing into the basket 84, larger foreign matter falls on the rearward (lower) side in the water, and water containing a smaller amount of foreign matter is filtered through the recycling water filtering wall portion 90. That is, this arrangement improves the efficiency of filtering the washing water and the rinsing water in the filter unit 15.

Configuration of Control Circuit

Figure 15:
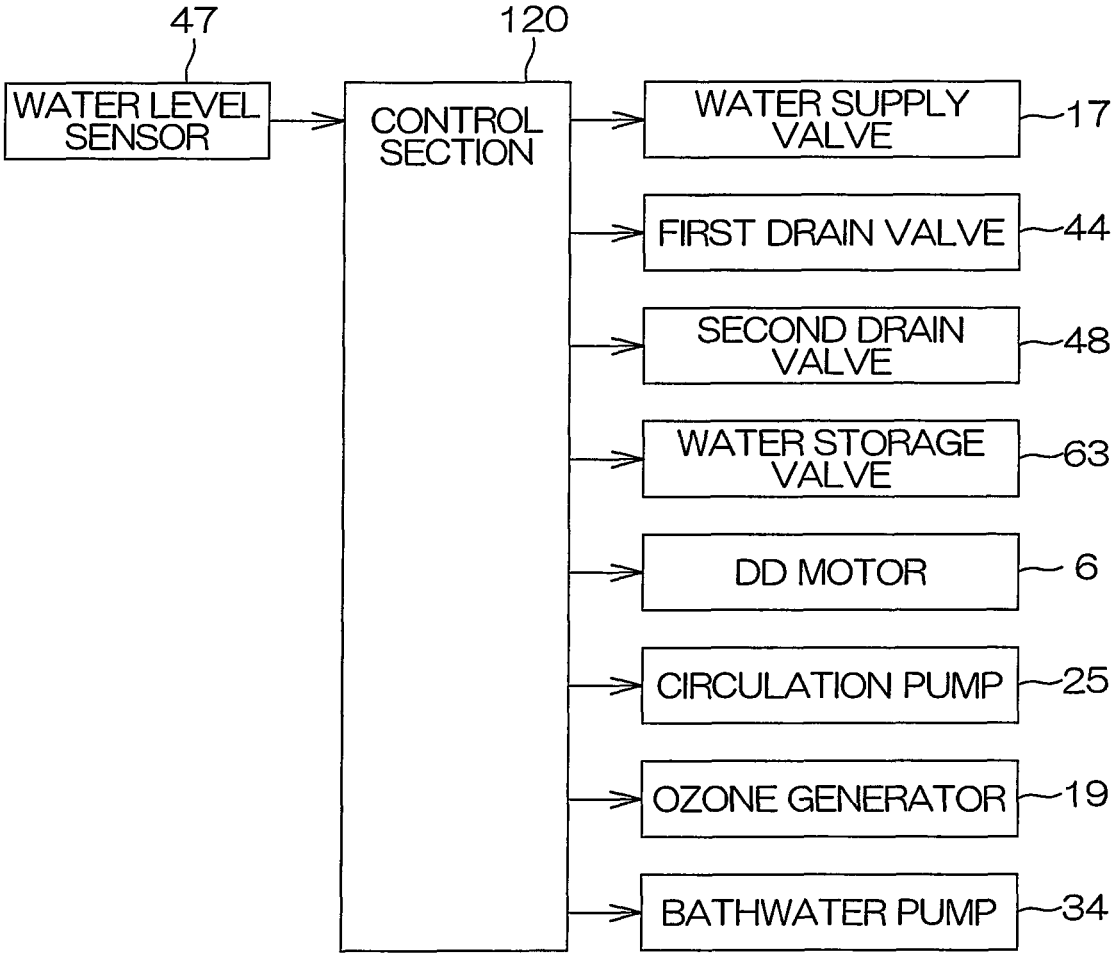
FIG. 15 is a block diagram for explaining the configuration of an electric control circuit of the washing/drying machine 1.

FIG. 15 is a block diagram for explaining the configuration of an electric control circuit of the washing/drying machine 1. In the block diagram of FIG. 15, only components required for performing the washing step and the rinsing step in the washing/drying machine 1 are shown.

A control section 120 is a control center of the washing/drying machine 1, and includes a microcomputer. The control section 120 is provided, for example, in the electrical component 12 (see FIG. 1).

The water level detected by the water level sensor 47 (see FIG. 4) is inputted to the control section 120.

The water supply valve 17, the first drain valve 44, the second drain valve 48, the water storage valve 63, the DD motor 6, the circulation pump 25, the ozone generator 19 and the bathwater pump 34 are connected to the control section 120. The control section 120 controls the operations or the driving of these components connected to the control section 120.

Control Operation for Washing Step and Rinsing Step

Figure 16:
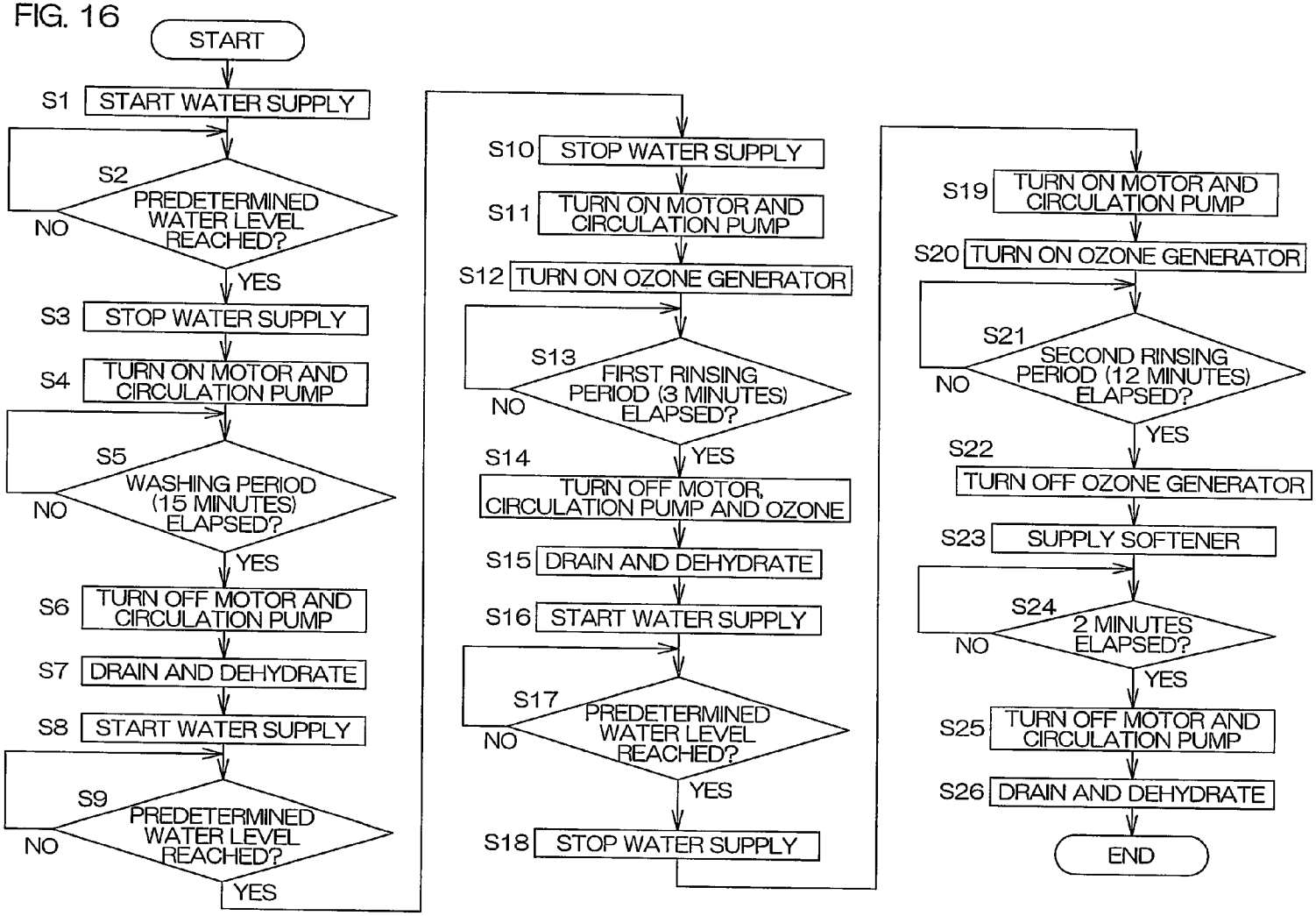
FIG. 16 is a flowchart for explaining operation control to be performed when the washing/drying machine 1 performs a washing step and a rinsing step with the use of tap water.

FIG. 16 is a flow chart for explaining operation control to be performed when the washing/drying machine 1 performs the washing step and the rinsing step. With reference to the flow chart of FIG. 16, a control operation to be performed in the washing step and the rinsing step in the washing/drying machine 1 will be described.

The laundry process to be performed by the washing/drying machine 1 is divided into the washing step, a first rinsing step and a second rinsing step. The control operation is directed to a case in which the washing operation and the rinsing operation are performed with the use of the tap water.

When the control operation is started in the washing step, water is supplied (Step S1). The water supply is started by opening the first outlet port 28 of the water supply valve 17 (see FIG. 4). Upon the start of the water supply, water flowing into the water supply port unit 18 from the first outlet port 28 flows through the priming water passage 33, the bathwater pump 34 and the water passage 37, and further flows into the washing tub 3 through the water supply passage 30, while the detergent contained in the detergent container 29 is dissolved in the water.

The water level in the washing tub 3 (outer tub 4) is monitored by the water level sensor 47, and applied to the control section 120. At the start of the water supply, the control section 120 maintains the first drain valve 44 in an open state, and maintains the second drain valve 48 and the water storage valve 63 in a closed state. Thus, the water supplied into the washing tub 3 flows into the drain port 152, the filter unit 15, the first water circulation passage 55, the storage water passage 62 and the water passage 45, but stopped by the second drain valve 48, the circulation pump 25 and the water storage valve 63. After these water passages are filled with the water, the water is retained in the washing tub 3.

At the start of the water supply, the control section 120 may maintain the first drain valve 44 in a closed state. In this case, the water supplied into the washing tub 3 flows into the water passage 43 from the drain port 42, but is stopped by the first drain valve 44 to be retained in the washing tub 3.

After the start of the water supply, the control section 120 judges whether the water level detected by the water level sensor 47 reaches a predetermined water level (Step S2) and, when the predetermined water level is reached, closes the water supply valve 17 to stop the water supply (Step S3).

Then, the DD motor 6 is driven to rotate the drum 5 alternately clockwise and counterclockwise, and the circulation pump 25 is driven (Step S4). Thus, the water in the washing tub 3 is circulated from the washing tub 3 through the drain port 42, the water passage 43, the first drain valve 44, the water passage 45, the filter unit 15, the first water circulation passage 55, the circulation pump 25, the second water circulation passage 57, the U-turn portion 26, the venturi tube 58 and the third water circulation passage 59 into the washing tub 3. With the circulation, the detergent flowing together with the water into the washing tub 3 from the detergent container 29 is smoothly dissolved in the water in a short period of time. Further, the detergent water containing the detergent dissolved therein is stirred by the circulation, so that the concentration of the detergent in the detergent water becomes even in a short period of time.

As described above, the circulation of the water to be used for the washing operation makes it possible to quickly dissolve the detergent in the water to provide detergent water having an even detergent concentration. In addition, the circulated water passes through the filter unit 15, so that dust in the water is trapped by the filter unit 15. Thus, the circulation removes the dust from the detergent water to clean the detergent water.

Then, it is judged whether an elapsed time reached a predetermined washing period, for example, 15 minutes (Step S5). If the elapsed time reaches the predetermined washing period, for example, 15 minutes, the driving of the DD motor 6 is stopped, and the driving of the circulation pump 25 is stopped (Step S6). Then, the second drain valve 48 is opened to drain the detergent water from the washing tub 3 into the drain trap 51. After the completion of the draining, the DD motor 6 is driven to rotate the drum 5 at a higher speed in one direction, whereby the garment retained in the drum 5 is dehydrated. The dehydrating operation to be performed at this time is referred to as "intermediate dehydrating operation" which is performed for a short period of time, for example, about 1 minute (Step S7).

A feature of the washing step is that the detergent water retained in the washing tub 3 is circulated by the circulation pump 25 but the ozone generator 19 is not actuated. In the washing step, the detergent water retained in the washing tub 3 is simply circulated, but the ozone-containing cleaning air is not mixed with the circulated detergent water.

After the completion of the washing step, the first rinsing step is performed. In the first rinsing step, the second drain valve 48 is closed, and the first outlet port 28 of the water supply valve 17 is opened to start water supply (Step S8). The water supplied from the first outlet of the water supply valve 17 flows into the washing tub 3 through the detergent container 29 of the water supply port unit 18 and the water supply passage 30. Since the detergent contained in the detergent container 29 flows into the washing tub 3 together with the water supplied in the washing step and does not remain in the detergent container 29, only the tap water is supplied into the washing tub 3. Based on the water level detected by the water level sensor 47, it is judged whether the level of the water retained in the washing tub 3 reaches the predetermined water level (Step S9). When the predetermined water level is reached, the water supply valve 17 is closed to stop the water supply (Step S10).

Then, the DD motor 6 is driven to rotate the drum 5 alternately clockwise and counterclockwise. Further, the circulation pump 25 is driven to circulate the water (rinsing water) from the washing tub 3 through the water circulation passage (42, 43, 44, 45, 15, 55, 25, 57, 26, 58, 59). During the circulation, the circulated water is filtered by the filter unit 15. If dust such as lint is contained in the circulated water, the dust is trapped by the filter unit 15. Thus, the circulation removes the dust from the water to clean the water.

In the first rinsing step, the circulation pump 25 is driven, and the ozone generator 19 is actuated (Step S12). Upon the actuation of the ozone generator 19, the ozone is generated. The ozone generated by the ozone generator 19 flows through the air tube 61 and then into the venturi tube 58 through the air inlet port 60 by a negative pressure, and is mixed with the circulated water flowing through the venturi tube 58. Thus, the water circulated into the washing tub 3 contains the ozone-containing air as the cleaning air. As a result, the residual detergent component remaining in the rinsing water is oxidized by the strong oxidation power and the sterilization power of the ozone to be thereby removed.

In this embodiment, the first rinsing step is performed for a relatively short period, for example, 3 minutes. Then, it is judged whether an elapsed time reaches 3 minutes (first rinsing period) (Step S13). After a lapse of 3 minutes, the driving of the DD motor 6 and the circulation pump 25 is stopped, and the ozone generator 19 is deactuated (Step S14).

Then, the second drain valve 48 is opened to drain the rinsing water from the washing tub 3 into the drain trap 51. After the completion of the draining, the DD motor 6 is driven to rotate the drum 5 at a higher speed in the one direction, whereby the intermediate dehydrating operation is performed to dehydrate the garment in the drum 5 (Step S15). The intermediate dehydration period is set to a relatively short period, for example, about 1 minute.

After the first rinsing step, the second rinsing step is performed.

In the second rinsing step, the second drain valve 48 is closed, and the first outlet of the water supply valve 17 is opened to start supplying the tap water (Step S16). Based on the water level detected by the water level sensor 47, it is judged whether the water level in the washing tub 3 reaches the predetermined water level (Step S17). When the predetermined water level is reached, the water supply valve 17 is closed to stop the water supply (Step S18).

Then, the DD motor 6 is driven to rotate the drum 5 alternately clockwise and counterclockwise, and the circulation pump 25 is driven, whereby the rinsing water retained in the washing tub 3 is circulated (Step S19). Further, the ozone generator 19 is actuated (Step S20).

Upon the actuation of the ozone generator 19, the ozone-containing air is mixed with the circulated water in the gas-liquid mixer 27. Thus, the rinsing water in the washing tub 3 contains the ozone having the strong oxidation power and the sterilization power, thereby achieving removal of bacteria adhering to the garment, decomposition of odorant and decomposition of greasy dirt which adheres to the garment even after the washing with the detergent.

A second rinsing period is, for example, 12 minutes. That is, the second rinsing step is performed for 12 minutes, which is longer than the first rinsing period. In the second rinsing step, the ozone-containing cleaning air mixed with the rinsing water sterilizes the garment, decomposes the odorant and decomposes the greasy dirt which adheres to the garment even after the washing with the detergent. Thus, the rinsing operation is advantageously performed.

After a lapse of 12 minutes (Step S21), the ozone generator 19 is deactuated (Step S22).

Where the softener is to be supplied, a softener supplying operation is performed (Step S23). For the supply of the softener, the second outlet port 31 of the water supply valve 17 (see FIG. 4) is opened to cause the tap water to flow into the softener containing chamber defined in the detergent container 29 of the water supply port unit 18, and further flow into the washing tub 3 through the water supply passage 30. When the water passes through the softener containing chamber, the softener flows together with the water into the washing tub 3. The softener supplying operation is completed by supplying a predetermined amount of water or controlling a valve opening period during which the water supply valve 17 is opened. Thereafter, the reciprocal driving of the drum 5 and the circulation of the water in the washing tub 3 are continued for 2 minutes (Step S24). After a lapse of 2 minutes, the driving of the DD motor 6 is stopped, and the driving of the circulation pump 25 is stopped (Step S25).

Thus, the second rinsing step is completed, and the second drain valve 48 is opened to drain the rinsing water from the washing tub 3 into the drain trap 51 (Step S26). After the draining, the DD motor 6 is driven to rotate the drum 5 at a higher speed in one direction. Thus, a final dehydrating operation is performed (Step S26).

In the embodiment described above, the first rinsing period and the second rinsing period are set by way of example, and may be periods other than specified in this embodiment. However, one of the features of the present invention is that the second rinsing period is longer than the first rinsing period. Therefore, the rinsing operation is advantageously performed with the use of the cleaning air (ozone) by increasing the second rinsing period.

Further, the ozone is supplied only when the use of the ozone is effective, so that the rinsing operation can be efficiently performed.

Figure 17A:
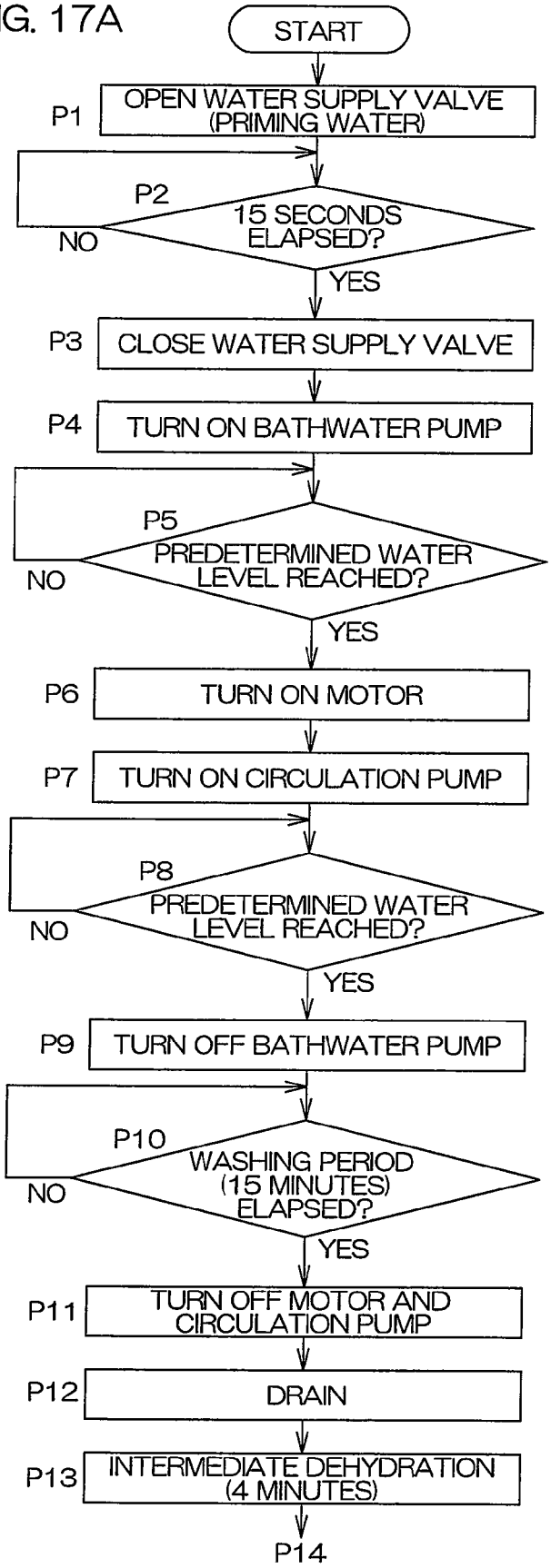
FIG. 17A is a flow chart for explaining operation control to be performed when the washing/drying machine 1 performs a washing step with the use of bathwater.
Figure 17B:
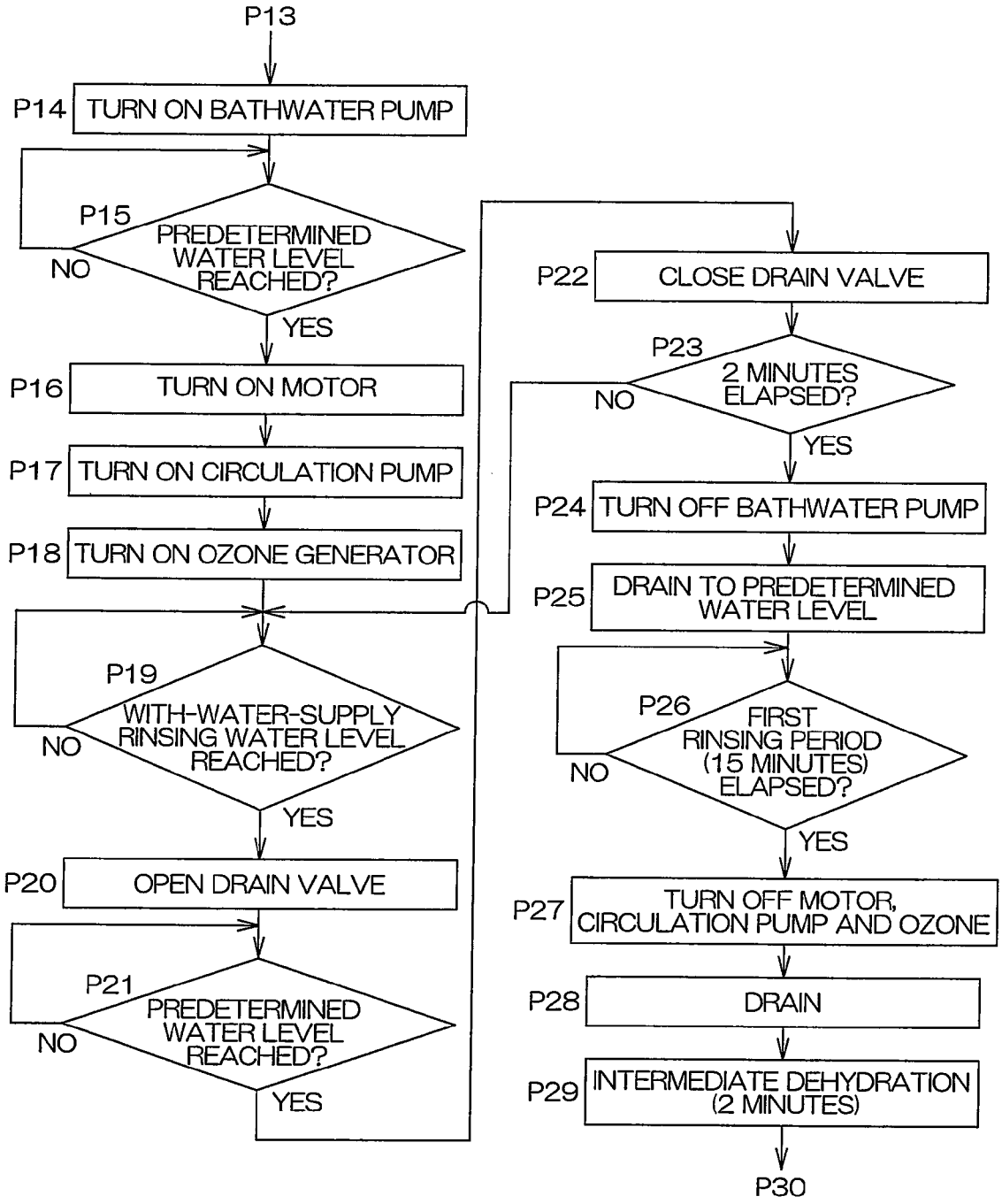
FIG. 17B is a flow chart for explaining operation control to be performed when the washing/drying machine 1 performs a first rinsing step with the use of bathwater.
Figure 17C:
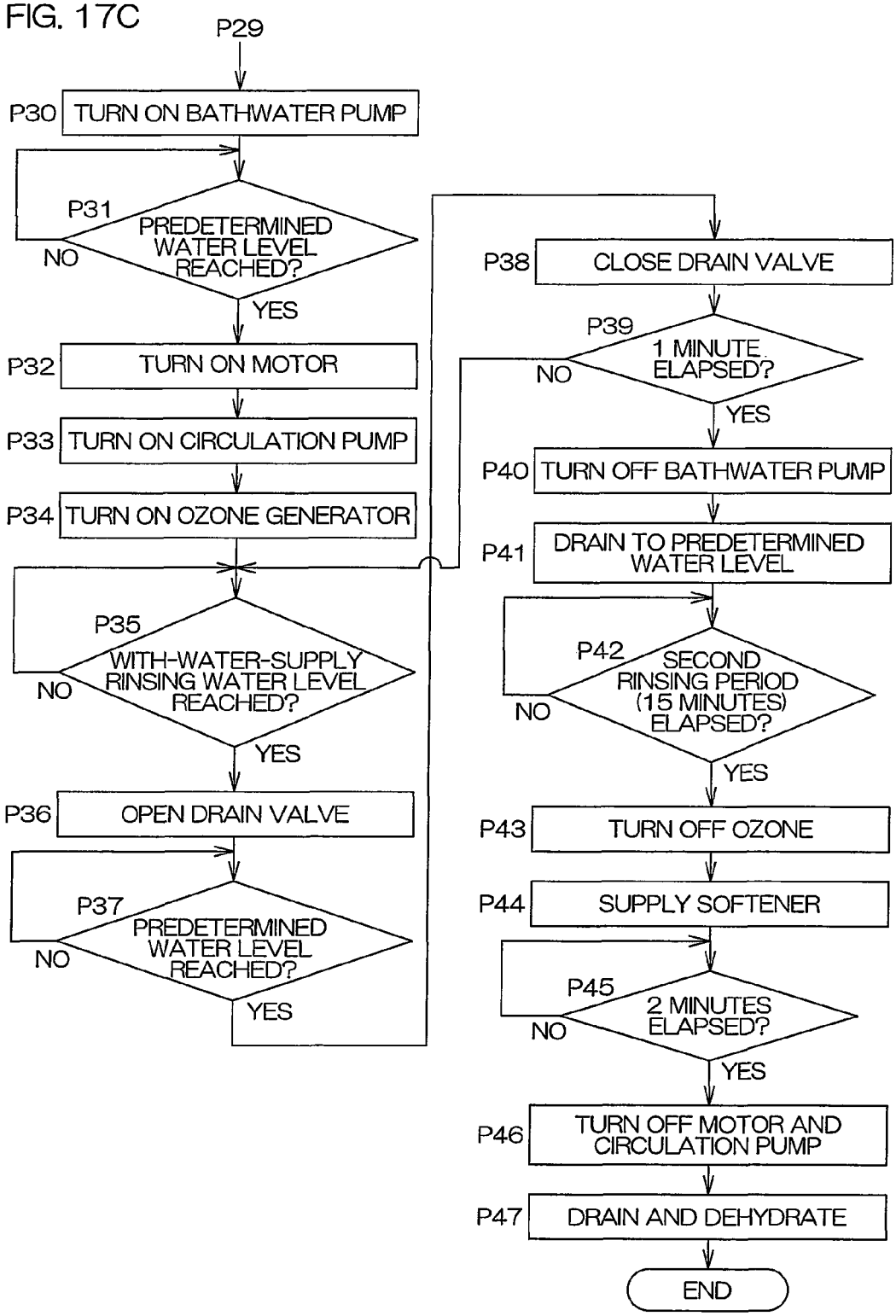
FIG. 17C is a flow chart for explaining operation control to be performed when the washing/drying machine 1 performs a second rinsing step with the use of bathwater.

FIGS. 17A, 17B and 17C are flow charts for explaining an exemplary control operation for the washing/drying machine 1. In these flow charts, the control operation is directed to a case in which the washing step and the rinsing step are performed with the use of the bathwater. In this control operation, the rinsing step includes a first rinsing step and a second rinsing step, but may include a first rinsing step, a second rinsing step and a third rinsing step.

With reference to the flow charts of FIGS. 17A, 17B and 17C, and FIG. 4, the control operation will be described.

When the control operation is started to start the washing step, the first outlet port 28 of the water supply valve 17 is opened for a predetermined period, for example, 15 seconds (Steps P1, P2 and P3). With the first outlet port 28 of the water supply valve 17 being open, the tap water is supplied into the water supply port unit 18 from the first outlet port 28. The water flows into the bathwater pump 34 through the priming water passage 33, and further flows through the bathwater pump 34, the water passage 37 and the detergent container 29 of the water supply port unit 18 and then into the washing tub 3 through the water passage 30. By opening the first outlet port 28 of the water supply valve 17 for a predetermined short period, priming water is supplied into the bathwater pump 34.

After the first outlet port 28 of the water supply valve 17 is closed in Step P3, the driving of the bathwater pump 34 is started (Step P4). By the driving of the bathwater pump 34, the bathwater is pumped up from the bathtub 35 through a bathwater hose 36, and flows into the detergent container 29 through the water passage 37. Then, the bathwater flows together with the detergent contained in the detergent containing chamber of the detergent container 29 into the washing tub 3 through the water supply passage 30.

In the water supply, the first drain valve 44 is opened, and the second drain valve 48 and the water storage valve 63 are closed. With the first drain valve 44 being open and with the second drain valve 48 being closed, the bathwater flowing into the washing tub 3 initially flows into the water passages 43, 45 from the drain port 42. However, after these water passages 43, 45 are filled with the bathwater, the bathwater is retained in the washing tub 3 without flowing out of the washing tub 3.

The water level in the washing tub 3 is detected by the water level sensor 47. If it is judged that the water level detected by the water level sensor 47 reaches a predetermined water level (washing start water level) (Step P5), the DD motor 6 is driven to rotate the drum 5 alternately clockwise and counterclockwise (Step P6). Further, the circulation pump 25 is driven (Step P7), so that the bathwater retained in the washing tub 3 is circulated from the drain port 42 through the water passage 43, the first drain valve 44, the water passage 45, the filter unit 15, the first water circulation passage 55, the circulation pump 25, the second water circulation passage 57, the U-turn portion 26, the venturi tube 58 and the third water circulation passage 59 into the washing tub 3. With the circulation, the detergent initially contained in the detergent container 29 and flowing together with the bathwater is quickly dissolved in the bathwater to provide detergent water for use in the washing step.

When the water level sensor 47 detects that the water level in the washing tub 3 reaches a predetermined water level (full capacity water level) (Step P8), the driving of the bathwater pump 34 is stopped (Step P9) to stop the supply of the bathwater into the washing tub 3. Then, the washing operation is performed with the use of the retained detergent water.

In turn, it is judged whether an elapsed time reaches a predetermined washing period, for example, 15 minutes (Step P10). After a lapse of 15 minutes, the driving of the DD motor 6 and the circulation pump 25 is stopped (Step P11). In the washing step, the drum 5 is rotated alternately clockwise and counterclockwise by the DD motor 6, while the water is circulated from the washing tub 3 by the circulation pump 25. Therefore, the detergent water in the washing tub 3 is properly stirred to an even detergent concentration by the circulation. Thus, the washing operation can be performed with higher cleaning efficiency.

In the washing step, the ozone generator 19 is not actuated, so that the ozone-containing cleaning air is not mixed with the circulated detergent water. Therefore, the detergent component is unlikely to be oxidized by the ozone, and free from reduction in cleaning ability.

In turn, the second drain valve 48 is opened to drain the water (Step P12). After the detergent water is drained from the washing tub 3, the DD motor 6 is driven to rotate the drum 5 at a higher speed in the one direction for the intermediate dehydrating operation (Step P13).

The intermediate dehydrating period in Step P13 differs depending on whether the first rinsing step is performed with the use of the bathwater or the tap water. More specifically, where the first rinsing step is performed with the use of the tap water, the intermediate dehydrating operation is performed for 1 minute (see Step S7 in FIG. 16). Where the first rinsing step is performed with the use of the bathwater as shown in these flow charts, the intermediate dehydrating operation is performed for 4 minutes. By increasing the intermediate dehydrating period for the first rinsing step to be performed with the use of the bathwater, the detergent water is sufficiently removed from the laundry. Therefore, when the bathwater is supplied in the first rinsing step, the amount of the residual detergent component released from the laundry is reduced, whereby the bathwater is properly sterilized.

Referring next to FIG. 17B, a control operation to be performed in the first rinsing step will be described.

In the first rinsing step, the driving of the bathwater pump 34 is started (Step P14). When the water level sensor 47 detects that the water level in the washing tub 3 reaches a predetermined water level for a rinsing operation without water supply (without-water-supply rinsing water level) (step P15), the DD motor 6 is driven to rotate alternately clockwise and counterclockwise (Step P16), and the circulation pump 25 is driven to circulate the water retained in the washing tub 3 (Step P17).

In the first rinsing step, the ozone generator 19 is actuated (Step P18). If the ozone generator 19 is actuated when the circulation pump 25 is driven to circulate the water, the ozone generated by the ozone generator 19 flows through the air tube 61 to be taken into the venturi tube 58 from the air inlet port 60 by a negative pressure, and is mixed with the circulated water.

When the water level detected by the water, level sensor 47 thereafter reaches a water level for a rinsing operation with water supply (with-water-supply rinsing water level) that is higher than the without-water-supply rinsing water level (the with-water-supply rinsing water level is a water level at which the water overflows from the overflow port 53) (Step P19), the second drain valve 48 is opened. Thus, the bathwater retained in the washing tub 3 is partly drained into the drain trap 51 (Step P20) to reduce the water level to the without-water-supply rinsing water level in the washing tub 3 (Step P21), and then the second drain valve 48 is closed (Step P22).

With the second drain valve 48 being closed, the bathwater is continuously supplied into the washing tub 3 by the bathwater pump 34, so that the water level in the washing tub 3 is increased again. Then, it is judged whether an elapsed time reaches a predetermined period, for example, 2 minutes (Step P23). A process sequence from Step P19 to Step P22 is repeated until a lapse of 2 minutes is detected. That is, an operation such that the water is supplied to the with-water-supply rinsing water level higher than the predetermined water level and then partly drained to the predetermined water level is repeatedly performed, whereby the residual detergent component remaining in the retained bathwater is diluted to a lower concentration.

Upon detection of a lapse of 2 minutes in Step P23, the driving of the bathwater pump 34 is stopped (Step P24), and the second drain valve 48 is opened again. When the water level in the washing tub 3 is reduced to the without-water-supply rinsing water level, the second drain valve 48 is closed (Step P25).

A process sequence from Step P19 to Step P25 is thus performed by supplying the bathwater into the washing tub 3 to the with-water-supply rinsing water level that is higher than the without-water-supply rinsing water level, partly draining the retained bathwater, increasing the water level again to the with-water-supply rinsing water level, and partly draining the bathwater to the without-water-supply rinsing water level. This process sequence reduces the amount of the residual detergent component released into the bathwater retained in the washing tub 3.

When the ozone-containing air is mixed with the circulated bathwater in the subsequent first rinsing step, the amount of the ozone consumed by the residual detergent component is reduced because the amount of the residual detergent component is reduced. Therefore, the ozone mainly acts on bacteria contained in the bathwater and bacteria and odorant adhering to the laundry as originally intended, so that the rinsing operation can be properly performed.

In Step P26, it is judged whether an elapsed time reaches a predetermined first rinsing period, for example, 15 minutes. After a lapse of 15 minutes, the driving of the DD motor 6 and the circulation pump 25 is stopped, and the ozone generator 19 is deactuated (Step P27).

The first rinsing period may be not shorter than 3 minutes and not longer than 15 minutes, or shorter than 15 minutes.

Thereafter, the second drain valve 48 is opened to drain the water from the washing tub 3 into the drain trap 51 (Step P28). After the draining, the DD motor 6 is driven to rotate the drum 5 at a higher speed in the one direction, whereby the intermediate dehydrating operation is performed, for example, for 2 minutes (Step P29). The period of the intermediate dehydrating operation to be performed after the first rinsing step is shorter than the period of the intermediate dehydrating operation to be performed in Step P13 after the washing step. This is because the amount of the residual detergent component contained in the laundry after the first rinsing step is smaller than the amount of the residual detergent component contained in the laundry after the washing step. Thus, the reduction in the period of the entire laundry process is primarily achieved by reducing the intermediate dehydrating period.

Referring next to FIG. 17C, the second rinsing step will be described.

After the intermediate dehydrating operation in Step P29, the second rinsing step is performed. The second drain valve 48 is closed, and the driving of the bathwater pump 34 is started (Step P30). When it is judged that the water level in the washing tub 3 reaches the predetermined without-water-supply rinsing water level (Step P31), the DD motor 6 is driven to rotate the drum 5 alternately clockwise and counterclockwise (Step P32). Further, the circulation pump 25 is driven (Step P33), and the circulation of the bathwater retained in the washing tub 3 is started. Further, the ozone generator 19 is actuated (Step P34) to mix the ozone with the circulated bathwater, whereby the bathwater is cleaned.

When the water level of the bathwater retained in the washing tub 3 reaches the with-water-supply rinsing water level by continuously driving the bathwater pump 34 (Step P35), the second drain valve 48 is opened (Step P36). When the bathwater retained in the washing tub 3 is partly drained to the without-water-supply rinsing water level (Step P37), the second drain valve 48 is closed (Step P38). Thereafter, it is judged whether an elapsed time reaches a predetermined period, for example, 1 minute (Step P39). A process sequence from Step P35 to Step P38 is repeated until a lapse of 1 minute is detected. That is, an operation such that the water is retained to the with-water-supply rinsing water level higher than the predetermined water level and then partly drained to the predetermined water level is repeated. Thus, the amount of the residual detergent component in the retained bathwater is reduced. The predetermined period is shorter than that in Step P23, because the amount of the residual detergent component is smaller in the second rinsing step than in the first rinsing step and consideration is given to the reduction in the rinsing period.

If the elapsed time reaches 1 minute in Step P39, the driving of the bathwater pump 34 is stopped (Step P40), and the second drain valve 48 is opened. When the water level in the washing tub 3 is reduced to the without-water-supply rinsing water level (predetermined water level), the second drain valve 48 is closed (Step P41).

A process sequence from Step P35 to P41 is performed in the same manner as the process sequence from Step P19 to Step P25 in the first rinsing step. That is, an operation such that the bathwater is supplied into the washing tub 3 in excess and then partly drained is repeated twice. Thus, the residual detergent component dissolved in the bathwater is partly released by the draining, whereby the concentration of the residual detergent component is reduced.

With the bathwater retained at the without-water-supply rinsing water level in the washing tub 3, the drum 5 is rotated alternately clockwise and counterclockwise, and the bathwater in the washing tub 3 is circulated. Thus, the rinsing operation is performed, while the ozone is mixed with the circulated bathwater for cleaning the bathwater. After a lapse of a predetermined second rinsing period, for example, 15 minutes (Step P42), the ozone generator 19 is deactuated (Step P43).

The flow chart of FIG. 17C is directed to a case in which the softener supplying operation is performed at the final stage of the second rinsing step. Where the softener is to be supplied, the ozone generator 19 is deactuated. Then, the softener supplying operation is performed (Step P44). The softener supplying operation is performed by opening the second outlet port 31 of the water supply valve 17, causing the tap water to flow into the softener containing chamber defined in the detergent container 29 of the water supply port unit 18, and causing the tap water to flow together with the softener into the washing tub 3 through the water supply passage 30. A period during which the second outlet 37 of the water supply valve 17 is opened, i.e., during which the tap water is supplied, is a predetermined period (e.g., about 30 seconds).

Then, the drum 5 is rotated alternately in opposite directions in the washing tub 3. If it is judged that an elapsed time reaches a period (e.g., 2 minutes) required for the supplied softener to be evenly distributed in the laundry by circulating the water by the circulation pump 25 (Step P45), the driving of the DD motor 6 and the circulation pump 25 is stopped (Step P46). The second drain valve 48 is opened to drain the water from the washing tub 3, and then the DD motor 6 is driven to rotate the drum 5 at a higher speed in the one direction. Thus, the final dehydrating operation is performed (Step P47).

In this embodiment, as described above, the control operation is performed so that the residual detergent component remaining in the laundry can be reduced as much as possible in the first rinsing step and the second rinsing step. This eliminates the disadvantageous possibility that the majority of the ozone would be consumed by the residual detergent component when the cleaning air containing the ozone generated by the ozone generator 19 is mixed with the bathwater. Therefore, it is possible to properly sterilize the bathwater with the ozone and hence perform the rinsing operation with the use of clean rinsing water. Further, bacteria and odorant adhering to the garment are decomposed by the ozone, so that the rinsing operation is advantageously performed.

The present invention is not limited to the embodiment described above, but various modifications may be made within the scope of the appended claims.

The invention claimed is:

1. A washing machine comprising:

a washing tub;

a water supply valve which is opened and closed to supply tap water into the washing tub;

a water circulation passage having opposite ends connected to the washing tub;

a bathwater hose connected to the water circulation passage and connected to a source of bathwater external to the machine for providing bathwater into the water circulation passage from a supply external to the washing machine;

a bathwater tank for storing bathwater;

a bathwater pump which is driven to supply bathwater from the bathwater tank through at least one tubular water passage and into the washing tub;

a circulation pump provided in the water circulation passage for pumping water out of the washing tub through one of the opposite ends of the water circulation passage and supplying the pumped water back into the washing tub through the other end of the water circulation passage;

a cleaning air generator which generates cleaning air;

a gas-liquid mixer provided in the water circulation passage for mixing the cleaning air generated by the cleaning air generator with water flowing through the water circulation passage; and a controller programmed to clean bathwater which actuates the cleaning air generator to mix the cleaning air with water circulated by driving the circulation pump in response to supply of the bathwater into the washing tub by the bathwater pump;

wherein the washing machine is capable of performing a washing step by using detergent water retained in the washing tub and containing a detergent dissolved therein, and then performing a rinsing step, and wherein the controller programmed to clean bathwater is operative only in the rinsing step; and wherein the washing machine is capable of performing an intermediate dehydrating step to remove the detergent water used in the washing step between the washing step and the rinsing step, and wherein the controller is programmed to conduct a rinsing step to be performed using tap water and a rinsing step to be performed using bathwater, an intermediate dehydration step following each rinsing step, the controller employing a longer dehydration step in the intermediate dehydrating step when the rinsing step is to be performed with the controller programmed to clean bathwater kept operative than when the rinsing step is to be performed by using the tap water.

2. A washing machine as set forth in claim 1, wherein the controller is programmed to actuate the cleaning air generator for a first predetermined amount of time when bathwater is supplied into the washing tub and for a second predetermined amount of time when the tap water is supplied into the washing tub, the first predetermined amount of time being longer than the second predetermined amount of time.

3. A washing machine as set forth in claim 1, further comprising a controller programmed to control a drain which, when the bathwater is supplied into the washing tub by driving the bathwater pump in the rinsing step, opens and closes a drain valve to drain water from the washing tub in predetermined timing relation with the supply of the bathwater.

4. A washing machine as set forth in claim 1, wherein the rinsing step in which the controller programmed to clean bathwater is operative includes a plurality of rinsing steps, and intermediate dehydrating steps to be performed before the respective rinsing steps, wherein a dehydration period is longer in an intermediate dehydrating step to be performed before a preceding rinsing step than in an intermediate dehydrating step to be performed before a subsequent rinsing step.

5. A washing machine as set forth in claim 1, wherein the rinsing step in which the controller programmed to clean bathwater is operative includes a plurality of rinsing steps, wherein a bathwater supply period is longer in a preceding rinsing step than in a subsequent rinsing step.

6. A washing machine as set forth in claim 1, wherein the rinsing step in which the controller programmed to clean bathwater is operative includes a plurality of rinsing steps, the washing machine further comprising finishing treatment controlling means which deactuates the cleaning air generator and supplies a softener into the washing tub in a last one of the rinsing steps.

* * * * *